US006007262A

United States Patent [19]

Kurashina

[11] Patent Number: 6,007,262

[45] Date of Patent: Dec. 28, 1999

[54] TAPE PRINTING APPARATUS

[75] Inventor: Hiroyasu Kurashina, Matsumoto, Japan

[73] Assignee: Seiko Epson Corporation, Tokyo, Japan

[21] Appl. No.: 09/199,659

[22] Filed: Nov. 25, 1998

[30] Foreign Application Priority Data

Nov. 28, 1997 [JP] Japan ..... 9-343896

[51] Int. Cl.[6] ..... B41J 11/26

[52] U.S. Cl. ..... 400/615.2; 400/83; 400/61

[58] Field of Search ..... 400/615.2, 61, 400/62, 63, 70, 76, 83; 395/117

[56] References Cited

U.S. PATENT DOCUMENTS

| | | | |
|---|---|---|---|
| 5,399,030 | 3/1995 | Niwa et al. | 400/61 |
| 5,494,360 | 2/1996 | Watanabe et al. | 400/83 |
| 5,584,591 | 12/1996 | Mori et al. | 400/615.2 |
| 5,680,520 | 10/1997 | Watanabe et al. | 400/61 |

FOREIGN PATENT DOCUMENTS

| | | | |
|---|---|---|---|
| 4288257 | 10/1992 | Japan . | |
| 6015909 | 1/1994 | Japan | B41J 21/00 |
| 6024084 | 2/1994 | Japan | B41J 21/00 |
| 7256942 | 10/1995 | Japan | B41J 3/36 |

*Primary Examiner*—Ren Yan
*Assistant Examiner*—Minh H. Chau
*Attorney, Agent, or Firm*—Loeb & Loeb LLP

[57] ABSTRACT

A tape printing apparatus is provided. Document data including character data, line feed data and division break-inserting data is input. An editing document formed of the document data is displayed. A position within the editing document is designated. A selected one of registered documents stored is called and inserted into the editing document as document data forming a new division of the editing document, at a predetermined one of a forward position immediately before a desired division within the editing document and a backward position immediately after the desired division, the desired division containing the designated position.

16 Claims, 23 Drawing Sheets

T01

| | |
|---|---|
| 1 | LETTER |
| 2 | PRINTING |
| 3 | A (n+1) ×d/b>x |
| 4 | !$#%=?:¥@& |

T02

| | |
|---|---|
| 1 | TTER |
| 2 | INTING |
| 3 | n+1) ×d/b>x+y |
| 4 | #%=?:¥@& |

T03

| | |
|---|---|
| 3 | A (n+1) ×d/b>x |
| 4 | !$#%=?:¥@& |
| 5 | ABCDEFG |
| 6 | abcdefghij |

U01

| | |
|---|---|
| 1 | LETTER |
| 2 | PRINTING |
| 3 | A (n+1) ×d/b>x+y |
| 4 | !$#%=?:¥@& |
| 5 | ABCDEFG |
| 6 | abcdefghij |

M01a

LETTER
PRINTING
A (n+1) ×d/b>x+y
!$#%=?:¥@&
ABCDEFG
abcdefghij

M01b

TAPE PRINTING APPARATUS

BACKGROUND OF THE INVENTION

1. Field of the Invention

This invention relates to a tape printing apparatus for printing entered characters, such as letters and symbols, on a tape, so as to obtain printed labels or the like.

2. Prior Art

Conventionally, in word processors or the like, it is a well-known function to designate a desired position in a document being edited on a display screen and call a selected one of registered (stored) documents to insert the same at the designated position in the document being edited. Normally, in a document prepared by using a word processor or the like, portions of the document separately and sequentially set forth on contiguous pages, that is, pages adjacent to each other, are grasped (read) as consecutive portions of the document, and hence, even if a page break is inserted at an intermediate portion of the registered document called and inserted, it gives little sense of disorder or incongruity.

On the other hand, in tape printing apparatuses, a printed portion of a tape is cut off and the cut-off piece of the tape is affixed to a desired object or article. Therefore, it is more important to make the appearance of the printed image attractive than to allow the reader to follow a sequence of contents set forth in separate paragraphs (divisions) contiguous in the direction of length of the tape. It should be noted that the paragraphs (divisions) of a document processed by the tape printing apparatus for printing on the tape correspond to pages of a document processed by the word processor. The attractive appearance of the printed image can be realized by making each breakpoint of contents of the document correspondent to a break of each paragraph (division) on the tape to cause a whole continuous or serial portion of the contents to be contained in each division, even if the length of lines (i.e. length of each division) may vary from division to division.

To this end, a tape printing apparatus has been proposed e.g. by (Japanese Laid-Open Patent Publication (Kokai) No. 6-15909) which incorporates the function of word processors described above and is improved in the above-mentioned respect in that when a registered document is called and inserted into a document being edited, division break-inserting data is inserted, for instance, immediately before or immediately after the inserted registered document to thereby insert the registered document as an independent or separate division.

In the proposed tape printing apparatus, however, attention is paid only to the registered document and hence, if the registered document is called when a cursor for designating an inserting position is located at an intermediate portion of a division of the document being edited i.e. document for editing (hereinafter referred to as "editing document"), the result is that the continuous or serial contents of the division of the editing document is separated by the inserted document.

FIG. 22 shows an editing document U91, which is being prepared for printing and provides a print image M91 when printed, and a registered document U97, which was prepared and registered to provide a print image M97 when printed. When the registered document is called and inserted into the editing document, if the cursor K for designating an inserting position is located at an intermediate portion of a division of the editing document U91 (screen T91), the series of document data of the division of the editing document are undesirably separated (screen T100), and provides a print image M100 when printed.

In the above process, if the user has carried out a call-and-insert operation without being conscious of the above inconvenience, he has to take the trouble of restoring the separated editing document at the cost of time and effort. Further, to prevent the above problem, it is required that the user finds out a breakpoint between divisions of an editing document where a called registered document should be inserted, by viewing the editing document on a display screen smaller in size than that of a word processor, and then accurately places the cursor at the breakpoint before a call-and-insert operation carried out for the registered document. In any case, the call-and-insert operation has been a troublesome time-consuming one.

SUMMARY OF THE INVENTION

It is the object of the invention to provide a tape printing apparatus which is capable of calling and inserting a registered document into an editing document on a division-by-division basis, without separating continuous contents of a division of the editing document, even if the call-and-insert operation is carried out without much attention.

It is a second object of the invention to provide a method of calling and inserting a registered document into an editing document for use by a tape printing apparatus, on a division-by-division basis, without separating continuous contents of a division of the editing document, even if the call-and-insert operation is carried out without much attention.

To attain the first object, according to a first aspect of the invention, there is provided a tape printing apparatus comprising:

- input means for inputting document data including character data, line feed data, and division break-inserting data;
- display means for displaying an editing document formed of the document data;
- registration means for registering the editing document as one of registered documents;
- storage means for storing at least one of the registered documents;
- position-designating means for designating a position within the editing document;
- insertion means for calling a selected one of the registered documents and inserting the called selected one of the registered documents into the editing document as document data forming a new division of the editing document, at a predetermined one of a forward position immediately before a desired division within the editing document and a backward position immediately after the desired division, the desired division containing the position designated by the position-designating means; and
- printing means for printing the editing document or any of the registered documents on a tape.

According to this tape printing apparatus, a called registered document is inserted as document data forming a new division, e.g. immediately after a division containing the position designated by the position-designating means. Therefore, if the editing document is printed in this state, the registered document can be printed on a tape as a new division, e.g. immediately after the division containing the designated position. If the editing document is registered and then the registered document is printed, the same result can be obtained. Further, if the printed tape is cut off, it is possible to create a label or the like in which breakpoints of text or writing data are made correspondent to respective breaks between divisions of the label.

In the above process, the position designated by the position-designating means may be at any location in the editing document. That is, even if an intermediate portion of a division is designated, called registered document can be inserted without separating series of document data within the division.

This is true even when the editing document into which the called registered document is to be inserted is comprised of a plurality of divisions. Whichever position in a desired one of the plurality of divisions the position-designating means may designate, the called registered document can be inserted as document data forming a new division, e.g. immediately after the division containing the designated position.

As a result, it is possible to call and insert a registered document on a division-by-division basis, without separating series of document data within a division of an editing document, even if the call-and-insert operation is carried out without much attention.

When a registered document is called and inserted immediately before the division containing the designated position, the same advantageous effects can be obtained.

Preferably, the tape printing apparatus includes designation area-defining means for defining at least one of three kinds of designating areas consisting of a forward insertion-designating area, a backward insertion-designating area, and an insertion inhibition-designating area, for each division of the editing document, and the insertion means includes:

forward insertion means for inserting the called selected one of the registered documents at the forward position immediately before the desired division when the designated position is within the forward insertion-designating area of the desired division;

backward insertion means for inserting the called selected one of the registered documents at the backward position immediately after the desired division when the designated position is within the backward insertion-designating area of the desired division; and insertion inhibiting means for inhibiting insertion of the called selected one of the registered documents when the designated position is within the insertion inhibition-designating area of the desired division.

According to this preferred embodiment, at least one of a forward insertion-designating area, a backward insertion-designating area and an insertion inhibition-designating area is defined for each division of an editing document.

When the forward insertion-designating area is defined in a division, if a position in this area is designated by the position-designating means, a registered document can be called and inserted into a location immediately before the division. In this case, whichever position in the designation area the position-designating means may designate, the called registered document can be inserted as document data forming a new division immediately before the division containing the designated position, so that it is possible to insert called registered document on a division-by-division basis, without separating series of document data in the division of the editing document, even if the call-and-insert operation is carried out without much attention.

Further, in the above case, assuming that the area other than the forward insertion-designating area is defined as a backward insertion-designating area, by designating a position in this designation area, a registered document can be called and inserted as document data forming a new division immediately after the division containing the designated area, and at the same time, whichever position in the whole area of the division may be designated, the called registered document can be inserted immediately before or immediately after the division, which makes it possible to prevent the separation of series of document data within the division of the editing document. Furthermore, if the area other than the forward insertion-designating area is defined as an insertion inhibition-designating area, the called registered document is inhibited from being inserted when this area is designated by the position-designating means, which makes it possible to prevent separation of series of document data within the division.

Further, when the backward insertion-designating area is defined in a division, if a position in the area is designated by the position-designating means, the called registered document can be inserted immediately after the division, and whichever position in the area the position-designating means may designate, the called registered document can be inserted as document data forming a new division, so that it is possible to obtain the same advantageous effects as obtained by defining the forward insertion-designating area is described above.

Similarly, if the area other than the backward insertion-designating area is defined as a forward insertion-designating area, whichever position in the whole area of the division may be designated, a registered document can be called and inserted immediately before or immediately after the division, which makes it possible to prevent the separation of series of document data within the division of the editing document. If the area other than the backward insertion-designating area is defined as an insertion inhibition-designating area, the called registered document is inhibited from being inserted when the area is designated by the cursor, which makes it possible to prevent the separation of series of document data within the division of the editing document.

Further, when the insertion inhibition-designating area is defined in a division, a called registered document is inhibited from being inserted if the insertion inhibition-designating area is designated by the position-designating means, which makes it possible to prevent the separation of series of document data in the area. In this case, if the other area than the insertion inhibition-designating area is defined as at least one of the forward insertion-designating area and the backward insertion-designating area, by designating a position in the at least one area, called registered document can be inserted either immediately before or after the division containing the area. Further, if the whole area of each division is defined as any of the designated areas, it is possible to prevent the separation of series of document data in the division of the editing document.

When the forward insertion-designating area and the backward insertion-designating area are each defined in a division, by designating a position in these areas, a registered document can be called and inserted immediately before or after the division containing the areas. In this case, whichever position in the areas the position-designating means may designate, the called registered document can be inserted as document data forming a new division immediately before or immediately after the division containing the designated position, so that it is possible to insert the called registered document on a division-by-division basis, without separating series of document data in the division of the editing document, even if the call-and-insert operation is carried out without much attention. Further, if the area other than the forward and backward insertion-designating areas is defined as an insertion inhibition-designating area, the called registered document is inhibited from being inserted when the area is designated, which makes it possible to prevent the separation of series of document data within the division of the editing document.

More preferably, the designation area-defining means includes automatic defining means for defining the remaining area of a division of the editing document for which at least one of the three kinds of designating areas is defined, as a predetermined one of the remaining two kinds of the designating areas other than the at least one of the three kinds of designating areas.

For instance, when the forward insertion-designating area is defined for the division of the editing document, the automatic defining means defines the remaining area of the division other than the forward insertion-designating area, as the backward insertion-designating area.

For instance, when the forward insertion-designating area and the backward insertion-designating area are defined for the division of the editing document, the automatic defining means defines the remaining area of the division other than the forward insertion-designating area and the backward insertion-designating area, as the insertion inhibition-designating area.

In a preferred embodiment, the designation area-defining means defines all area of each division of the editing document as the backward insertion-designating area.

Alternatively, the designation area-defining means defines a forward half of each division of the editing document as the forward insertion-designating area and a backward half of the each division as the backward insertion-designating area.

In a preferred embodiment, the editing document includes line number data, and the designation area-defining means defines an area occupied by the line number data and an area occupied by the character data as respective different ones of the forward insertion-designating area and the backward insertion-designating area.

In another preferred embodiment, the position-designating means designates the position within the editing document before the insertion means calls the selected one of the registered documents.

Alternatively or depending on the case, the position-designating means designates the position within the editing document after the insertion means calls the selected one of the registered documents.

In a preferred embodiment, the designation area-defining means includes means for defining any of the three kinds of designation areas on a line-by-line basis, and the position-designating means designates the position on a line-by-line basis.

In another preferred embodiment, the designation area-defining means may include means for defining any of the three kinds of designation areas on a division-by-division basis, and the position-designating means may designate the position on a division-by-division basis.

Further preferably, the display means includes means for displaying divisions of the editing document schematically as respective lines when the position is to be designated by the position-designating means.

More preferably, when the document is printed on the tape, the each division of the editing document is printed over the whole width of the tape, forming a sequence of printed divisions along the length of the tape.

To attain the second object, according to a second aspect of the invention, there is provided a method of calling a registered document and inserting the registered document into an editing document for use by a tape printing apparatus, comprising the steps of:

inputting document data including character data, line feed data, and division break-inserting data;

displaying an editing document formed of the document data;

designating a position within the editing document; and calling a selected one of registered documents stored in storage means and inserting the called selected one of the registered documents into the editing document as document data forming a new division of the editing document, at a predetermined one of a forward position immediately before a desired division within the editing document and a backward position immediately after the desired division, the desired division containing the position designated by the position-designating means.

According to this method, it is also possible to obtain the same advantageous effects as obtained by the method according to the first aspect of the invention.

The above and other objects, features, and advantages of the invention will become more apparent from the following detailed description taken in conjunction with the accompanying drawings.

DETAILED DESCRIPTION

The invention will now be described in detail with reference to drawings showing an embodiment thereof.

Figure 1:
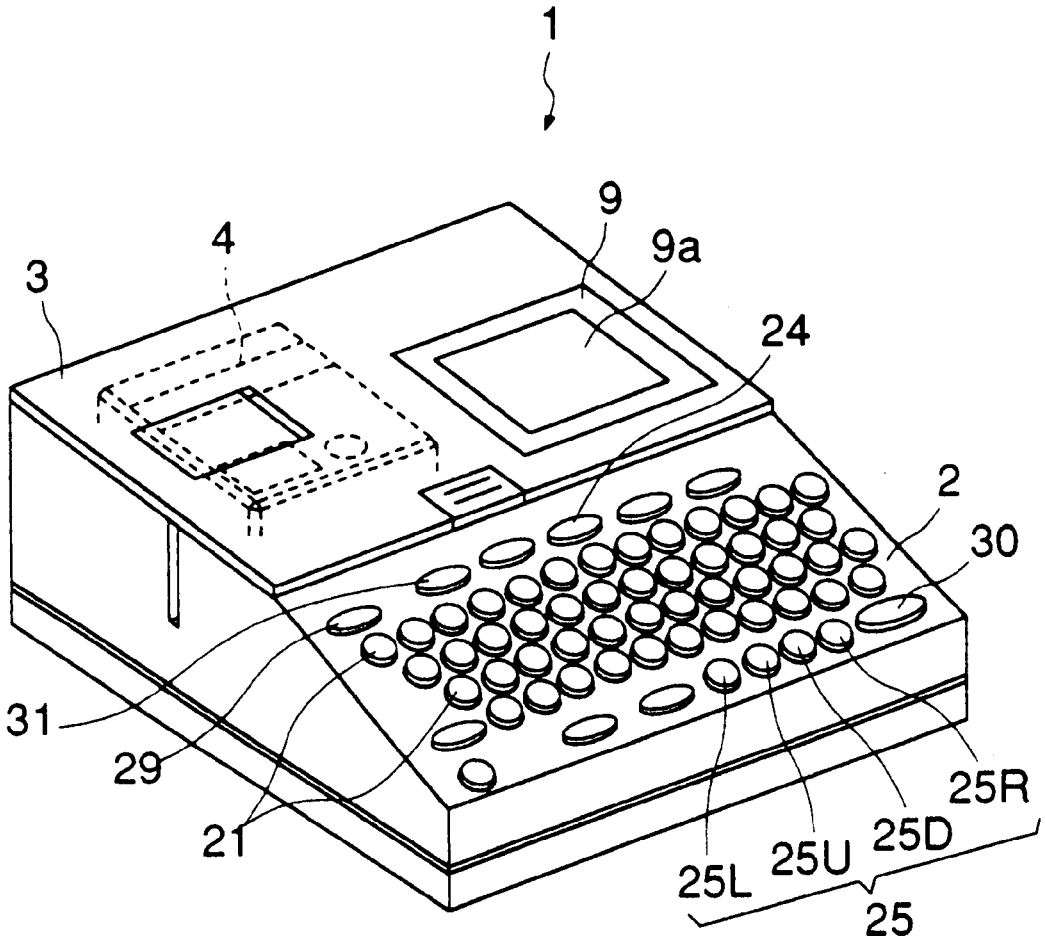
FIG. 1 is a perspective view of an appearance of a tape printing apparatus according to an embodiment of the invention.
Figure 2:
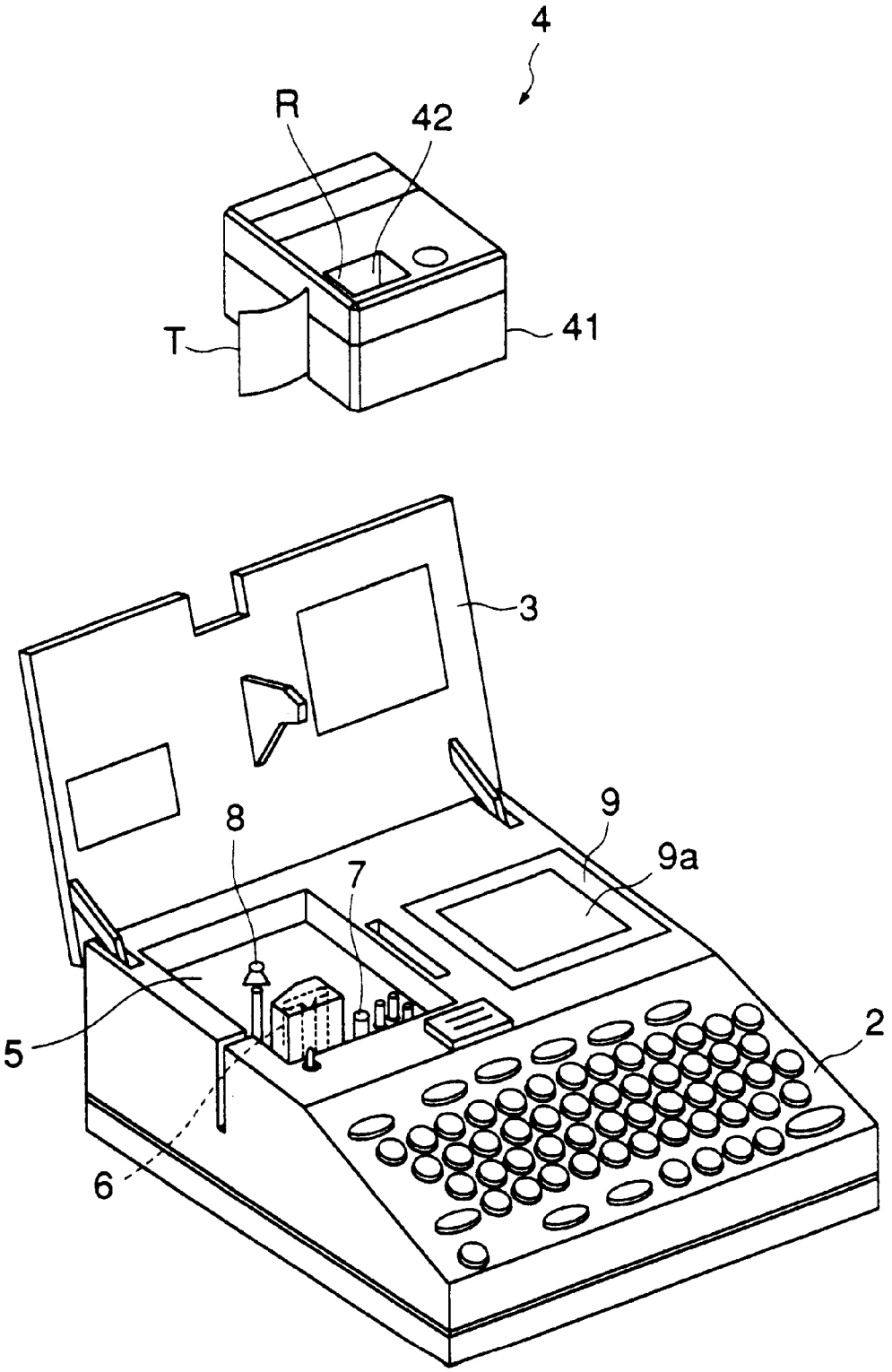
FIG. 2 is a perspective view of the FIG. 1 tape printing apparatus with its lid open.

Referring first to FIGS. 1 and 2, there is shown the whole arrangement of a tape printing apparatus according to an embodiment. As shown in the figures, the printing apparatus 1 includes a keyboard 2 arranged on a front-side portion of a top thereof, a lid 3 mounted on a rear-side portion of the same, and a liquid crystal display 9 arranged such that the same faces a window formed on a right side of the lid 3. The liquid crystal display 9 has a display screen 9*a* which is capable of displaying four lines each formed by a line number and twelve characters at the maximum, in a normal text display mode.

On the keyboard 2 there are arranged a character key group 21 including alphabet keys, number keys and symbol keys, and a function key group for designating various operation modes and the like. The function key group includes a file/format key 24 for handling files and selecting print formats, four cursor-moving keys 25 (25R, 25D, 25U and 25L) for moving a cursor in respective rightward (→), downward (↓), upward (↑), and leftward (←) directions (hereinafter these keys will be referred to as "the cursor "→" key 25R", "the cursor "↓" key 25D", "the cursor "↑" key 25U" and "the cursor "←" key 25L" respectively, whereas when collectively called, they are referred to as the "cursor key 25"), a print key 29 for starting a printing operation, a selection key 30 for selecting modes and feeding lines during text entry, and a division break-inserting key 31 for inserting a division break between divisions in text data.

Although in the above case, similarly to the general case of assigning functions to keys, it is possible to assign a plurality of functions to a key operated in combination with a shift key or the like, here, for purposes of ease of understanding, the following description will be made assuming that the keyboard 2 has the above keys separately provided for the respective functions mentioned above.

As shown in FIG. 2, arranged under the lid 3 is a cartridge compartment 5 for loading a tape cartridge 4 therein. The tape cartridge 4 contains a tape T having a predetermined width. The tape T has an adhesive surface on the reverse side which is covered with a peel-off paper. The tape cartridge 4 contains an ink ribbon R together with the tape T. The tape T and the ink ribbon R are fed or run such that they pass by an open space 42 formed through a casing 41 of the tape cartridge 4, in a state lying one upon the other, and the tape T alone is delivered out of the tape cartridge 4 and then the apparatus 1, but the ink ribbon R is taken up into a roll within the tape cartridge 4.

The cartridge compartment 5 has a thermal head 6 (printing means) arranged therein, which abuts the reverse side of the ink ribbon R exposed to the open space 42 of the tape cartridge 4 when the tape cartridge 4 is loaded in the cartridge compartment 5 with the thermal head fitted in the open space 42. Then, by driving the thermal head 6 while heating the same, desired letters, etc. are printed on the surface of the tape T. Further, the cartridge compartment 5 is provided with drive shafts 7 and 8 for engagement with driven portions of the tape cartridge 4 loaded in the cartridge compartment 5. These drive shafts 7 and 8 cause the tape T and the ink ribbon R to be fed or carried in the tape cartridge 4.

Figure 3:
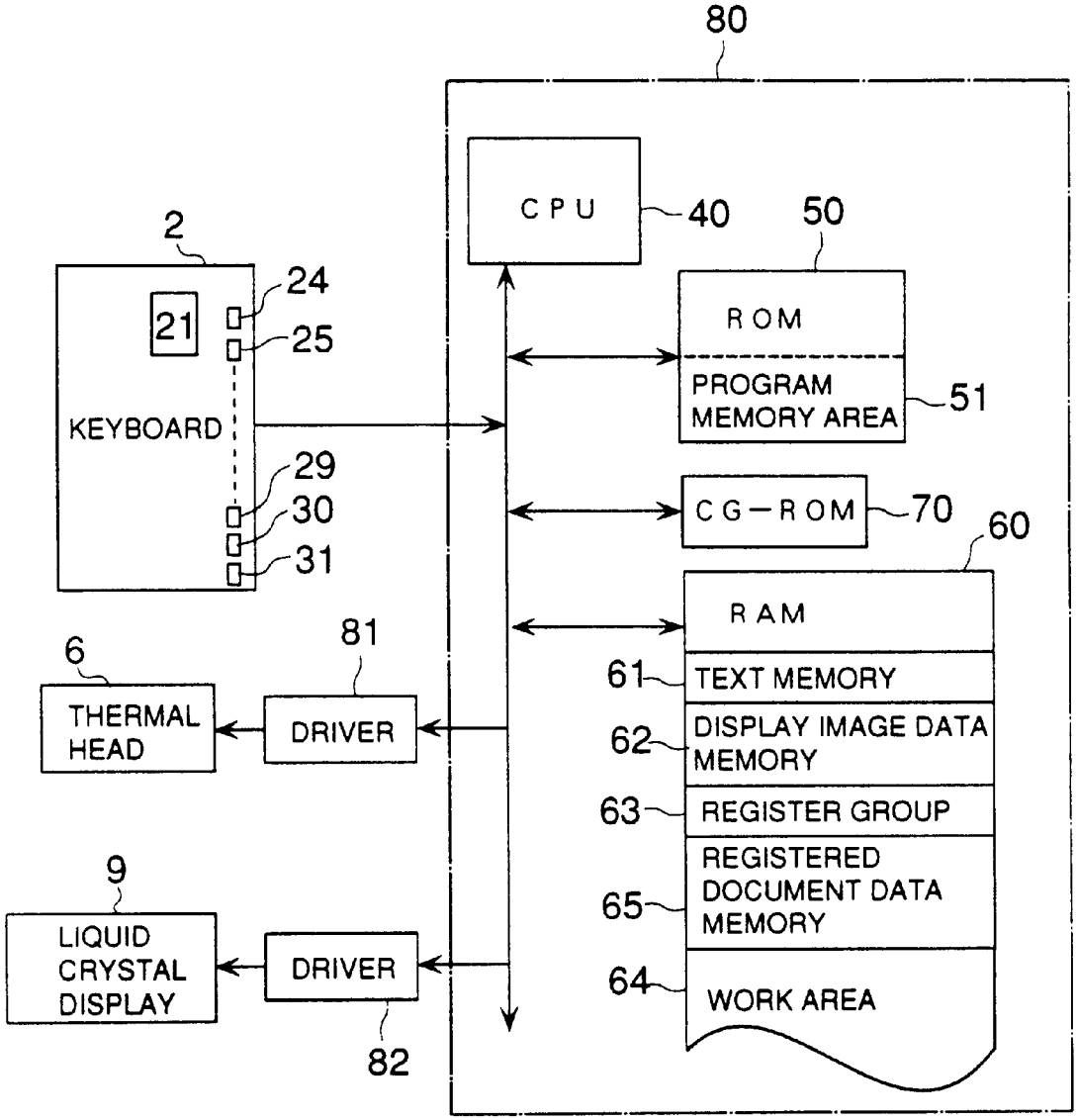
FIG. 3 is a block diagram schematically showing a control system of the FIG. 1 tape printing apparatus.

Next, referring to FIG. 3, a control system of the tape printing apparatus 1 will be described. The control system includes a control circuit 80 comprised of a CPU 40, a read only memory (ROM) 50, a random access memory (RAM) 60, and a character generator ROM (hereinafter referred to as "CG-ROM") 70. The control circuit 80 has an input port connected to the keyboard 2, and output ports connected to the thermal head 6 via a driver 81 for driving the same and the liquid crystal display 9 via a driver 82 for driving the same for display operation.

The ROM 50 has a program memory area 51 storing control programs for controlling the thermal head 6 and the liquid crystal display 9, and various programs for processing operations, described hereinafter.

The RAM 60 includes a text memory 61 for temporarily storing text data of letters and symbols entered via the keyboard 2, a display image data memory 62 for storing image data corresponding to contents displayed on the display screen 9*a* of the liquid crystal display 9, a register group 63 for temporarily storing results of processing by the CPU 40, a work area 64 used in forming image data and the like in various kinds of processes described hereinafter, and a registered document data memory 65, described hereinafter.

The CG-ROM 70 stores font data of letters and symbols provided for the tape printing apparatus 1, and outputs corresponding font data when code data specifying a letter or the like is given thereto.

Next, the overall control process carried out by the tape printing apparatus 1 will be described with reference to FIG. 4 et seq. Processes for basic operations of moving the cursor by the cursor key 25, etc., and other operations responsive to input via function keys, which are not directly related to the present invention, will be collectively shown as "PROCESS RESPONSIVE TO OTHER FUNCTION KEYS, ETC." (S11) in FIG. 4 and detailed description thereof will be omitted.

Figure 4:
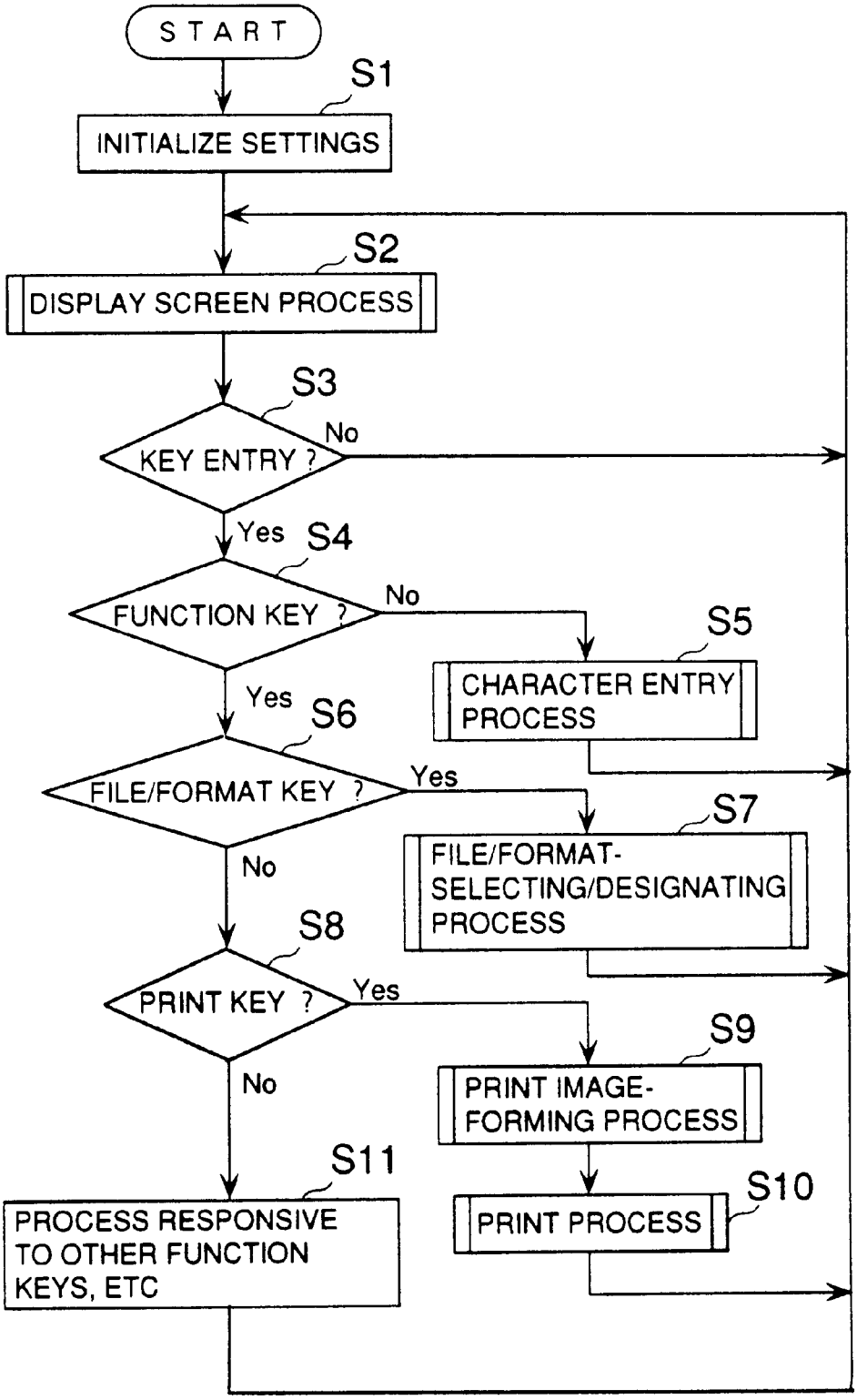
FIG. 4 is a flowchart showing an overall control process executed by the FIG. 1 tape printing apparatus.

As shown in FIG. 4, when the present control process is started by turning on the power of the apparatus 1, first, at a step S1, initialization of settings of the system, such as restoring of saved control flags, is carried out to restore the tape printing apparatus 1 to a state before the power was turned off. Then, a display screen process is carried out at a step S2.

Figure 5A:
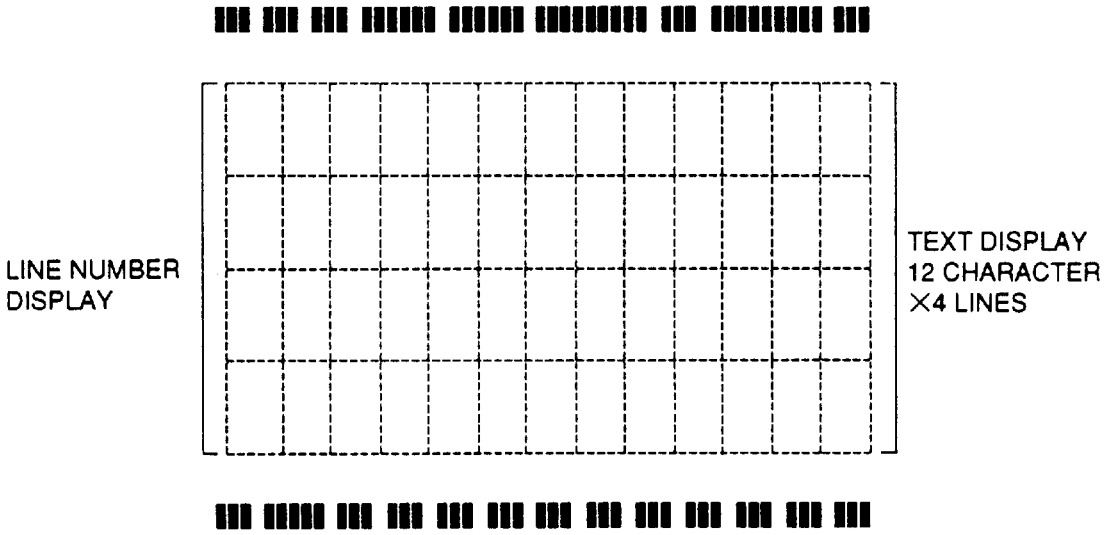
FIG. 5A is a diagram which is useful in explaining a display screen of a liquid crystal display which is capable of displaying line numbers and text data.
Figure 5B:
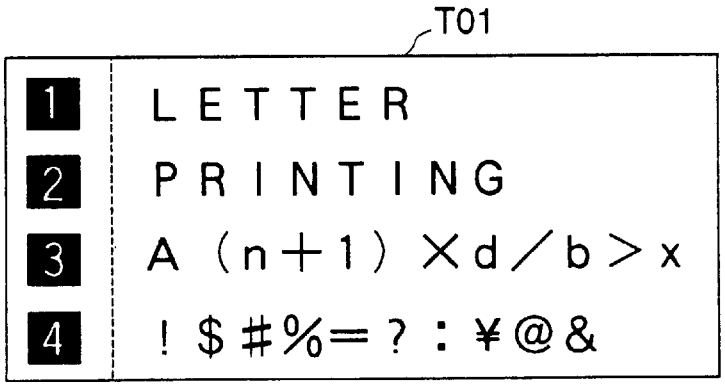
FIG. 5B is a diagram showing an example of display (display screen) displayed on the liquid crystal display.

The display screen 9*a*, as shown in FIG. 5A, is capable of displaying four lines each formed by a line number and a character string of twelve characters at the maximum. The display screen 9*a* is displayed e.g. as shown in FIG. 5B. (Hereinafter, contents or an image displayed on the display screen 9*a* is referred to as "screen T??" (? represents a digit) and the image is designated by reference numeral T??).

Figures 6A, 6B, 6C, 6D, 6E, 6F:
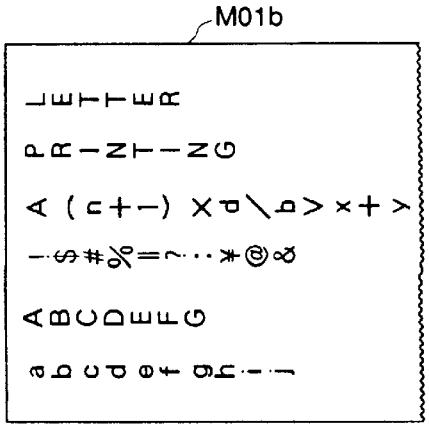
FIGS. 6A to 6D are diagrams showing examples of display screens of the liquid crystal display appearing in FIGS. 5A and 5B, with respective images of text data displayed thereon.
FIGS. 6E and 6F are diagrams each showing an example of a print image.

FIG. 6A shows the same screen T01 as shown in FIG. 5B, and the whole contents of text actually entered are shown in FIG. 6D (hereinafter, a text data item is referred to as "U??", an image data item created from the text data item U?? is referred to as "G??", and a print image formed by printing an image represented by the image data item G?? on the tape T is referred to as "M??", and a label image of a label obtained by cutting off a portion of the tape T having the print image M?? printed thereon is referred to as "R??". They are shown in FIG. 7 et seq. with these reference numerals for indication).

Now, by taking the above text data U01 as an example, the procedure of entering text data when the normal print format is designated will be described with reference to FIGS. 4 and 7.

Figure 7:
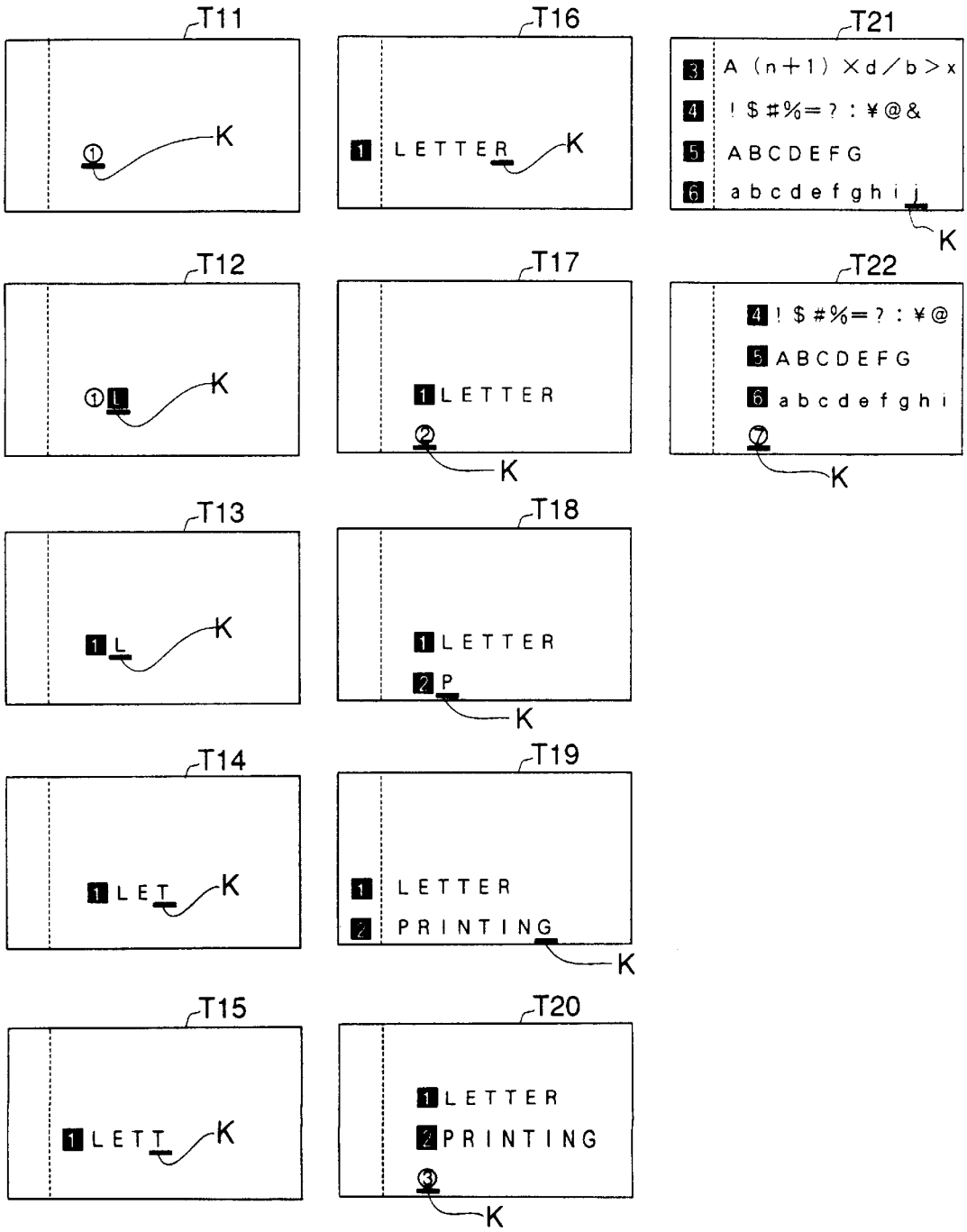
FIG. 7 is a diagram showing examples of screens displayed when text data is entered, in a simplified manner.

When the tape printing apparatus 1 is initialized to a screen T11 shown in FIG. 7, if an alphabet character "L" is entered via the keyboard 2, it is determined at a step S3 in FIG. 4 that a key entry has been made (Yes to S3). Then, after it is determined at a step S4 that the operated key is not a function key (No to S4), a character entry process is carried out at a step S5. In the character entry process (S5), the text data of "L" is stored in the text memory 61, and font data corresponding thereto is read from the CG-ROM 70, to store image data of "L" in reverse video at a location in the display image data memory 62 which corresponds to a position of image display data of the cursor K stored therein, whereby when the display screen process (S2) is executed again, a screen T12 as shown in FIG. 7 is displayed. The alphabet character "L" is displayed in reverse video to indicate that the entry thereof is not yet finally determined or fixed.

Then, if the selection key 30 is depressed to finally determine or fix the entry of the character "L", it is determined, as shown in FIG. 4, at the step S3 that a key entry has been made (Yes to S3), at the step S4 that a function key has been operated (Yes to S4), and at a step S6 that the operated function key is not the file/format key 24 (No to S6). After it is further determined at a step S8 that the operated key is not the print key 29 (No to S8), the final determination of text entry of the character "L" is effected at a step S11. That is, the image data of "L" in the display image data memory 62 in reverse video is replaced by an image data of the same in normal video. As a result, when the display screen process (S2) is carried out again, a screen T13 shown in FIG. 7 is displayed.

After the remaining text data "ETTER" of a character string "LETTER" on the first line is similarly entered as in screens T14 to T16 shown in FIG. 7, if the selection key 30 is depressed consecutively, a screen T17 shown in FIG. 7 is displayed in which text entry is requested for a second line. This is because the selection key 30 also plays the roll of a line feed key. When text data of a character string "PRINTING" is entered for the second line (screens T18 and T19 shown in FIG. 7) and the line is fed by operating the selection key 30 in the same manner, a screen T20 shown in FIG. 7 is displayed which requests entry of text data on a third line. When text data is similarly entered down to a sixth line (screen T21 shown in FIG. 7), and then the selection key 30 is depressed, a screen T22 shown in FIG. 7 appears which requests text entry on a seventh line, which completes the entry of text data intended at present.

In the text data entry process, code data of "Null"=(0000) HEX (hereinafter referred to as "the Null data") is always placed at a position following the position of the cursor which guides entry of text data, whereby text data is always entered immediately before the Null data. In other words, the Null data indicates the end of text data.

After the entry of text data, it is possible to make sure of the entered text data by operating the cursor key 25. For instance, by continually depressing the cursor "→" key 25R from the state shown in FIG. 6A, the displayed area is shifted toward the end of the line on which the cursor is positioned, whereby the entered text data (see T02 shown in FIG. 6B) can be checked, whereas by continually depressing the cursor "↓" key 25D, the displayed area is shifted to lower lines (screen T03 of FIG. 6C), similarly by the cursor "↑" key 25U, to upper lines, and by the cursor "←" key 25L, toward the head of the line on which the cursor is positioned.

If the print key 29 is depressed in the state of the above screen T02 or T03, it is determined at the step S3 in FIG. 4 that a key entry has been made (Yes to S3), at the step S4 that the operated key is the function key (Yes to S4), and at the step S6 that the operated key is not the file/format key 24 (No to S6). Then, after it is determined at the step S8 that the operated key is the print key 29 (Yes to S8), a print image-forming process is carried out at a step S9 to form print image data G01 corresponding to the text data U01 shown in FIG. 6D, and the printing is executed at a step S10 based on the print image data G01. Then, the screen returns to a key entry wait state at the step S2.

Unless a special format is specified in a file/format-selecting/designating process at a step S7, the normal print format is used, and hence in the print image-forming process (S9), character images are arranged along the length of the tape T, whereby characters are printed in lines parallel to each other in a direction (indicated by an arrow) of the feed of the tape T to form a print image M01*a* shown in FIG. 6E when a horizontal writing print format has been designated for the normal print format, or a print image M01*b* shown in FIG. 6F when a vertical writing print format has been designated for the same.

Figure 8A:
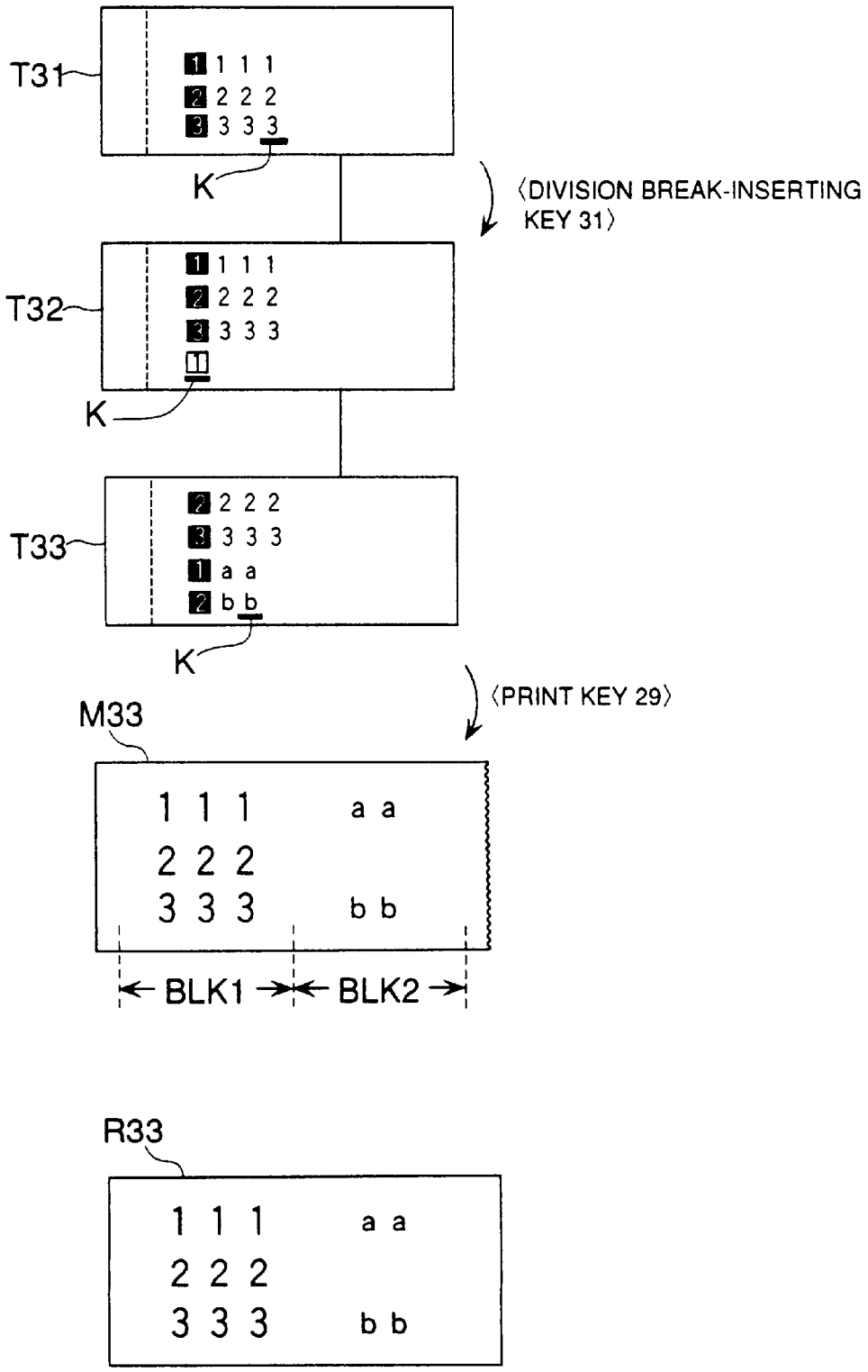
FIGS. 8A and 8B are diagrams schematically showing examples of respective sequences of screens displayed during a division break-inserting operation, as well as resulting text data and print images thereof.

Next, the operation of the division break-inserting key 31, and text data and print images formed when the division break-inserting key 31 is operated will be described. For instance, when numerals "111" are entered on a first line, "222" on a second line and "333" on a third line and then, as shown in FIG. 8A, if the division break-inserting key 31 is depressed in a state where the text entry screen is displayed for the normal print format (screen T31, hereafter "screen" will be omitted) and the cursor K is located at the end of a division (first division), text entry is requested on a first line of a next division (second division) (T32).

When the print key 29 is depressed after entering "aa" on a first line and "bb" on a second line, the first division BLK1 (hereinafter, an "n-th division" is indicated by "BLKn") comprised of the first line of "111", the second line of "222" and the third line of "333" and, similarly, the second division BLK2 comprised of the first line of "aa" and the second line of "bb" are printed on the tape T (print image M33: hereinafter "print image" will be omitted). At this time point, a label R33 can be prepared by cutting off the printed tape T.

Although detailed description is omitted, the tape printing apparatus 1 is configured such that the same is capable of setting a variety of printing styles depending on the number of lines on a division-by-division basis. For instance, let it be assumed that a printing style "Division comprised of three lines of small, large, and small character sizes with an outer frame" is set for a first division BLK1 and a printing style "Division comprised of two lines of large and small character sizes" is set for a second division BLK2.

Figure 8B:
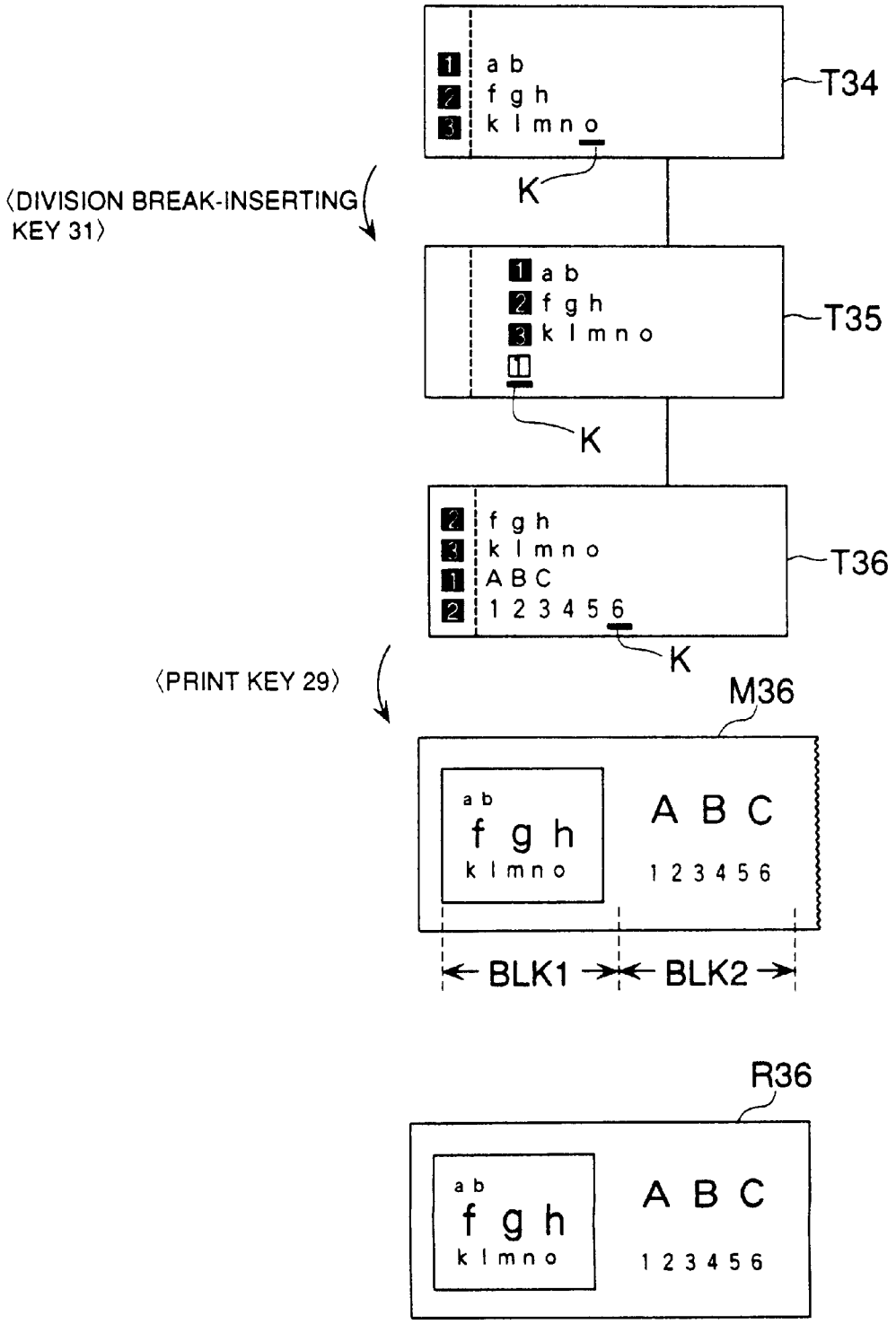

In this case, as shown in FIG. 8B, for instance, if a character string "ab" is entered on a first line of a first division BLK1, a character string "fgh" on a second line, and a characters string "klmno" on a third line (T34), and then the division break-inserting key 31 is depressed with the cursor K positioned at the end of the text, entry of text data is requested on a first line of a next division (T35). If the print key 29 is depressed after entering "ABC" on a first line of a second division BLK2 and numerals "123456" on a second line thereof (T36), the first division BLK1 and the second division BLK2 containing entered characters arranged according to the printing styles set therefor are printed (M36) on the tape T, and a label R36 can be obtained by cutting off the printed portion of the tape T.

Figure 9A:
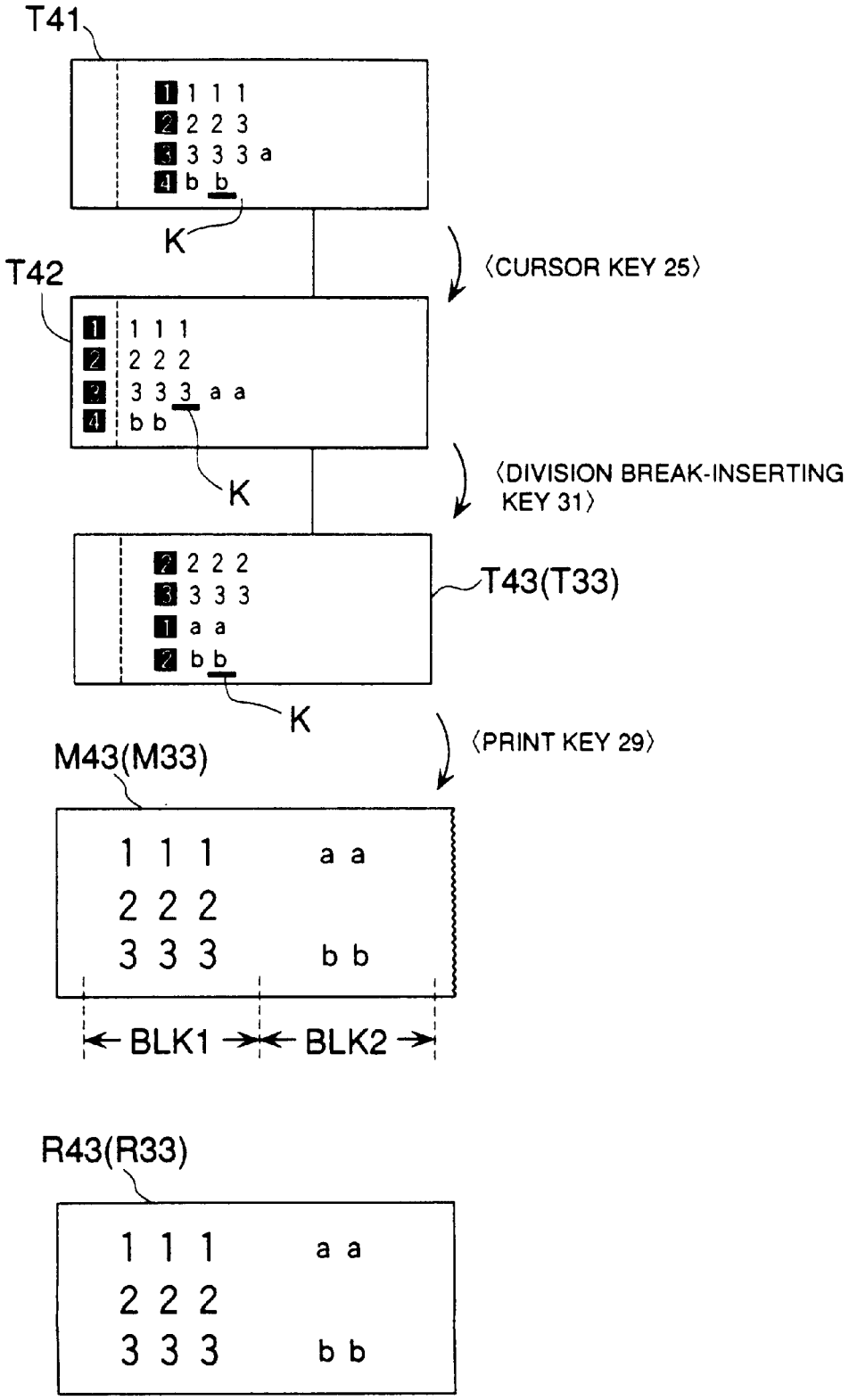
FIGS. 9A and 9B are diagrams similar to FIGS. 8A and 8B, showing other examples of respective sequences of screens, as well as resulting text data and print images thereof.

Next, a process carried out when a division break is inserted at an intermediate portion of a division will be described with reference to FIGS. 9A and 9B. For instance, as shown in FIG. 9A, in a state where numerals "111" have been entered on a first line, numerals "222" on a second line, numerals and alphabet characters "333aa" on a third line, and alphabet characters "bb" on a fourth line (T41), if the cursor key 25 is operated to place the cursor K at the third numeral "3" on the third line (T42) and then the division break-inserting key 31 is depressed, the alphabet characters "aa" are moved to a first line of a second division BLK2 and the alphabet characters "bb" are moved to a second line of the same (T43: identical to T33). Then, If the print key 29 is depressed, the first division BLK1 and the second division BLK2 containing the entered characters are printed (M43: the same as M33) on the tape T. and a label R43 (identical to R33) is obtained by cutting off the printed portion of the tape T.

Figure 9B:
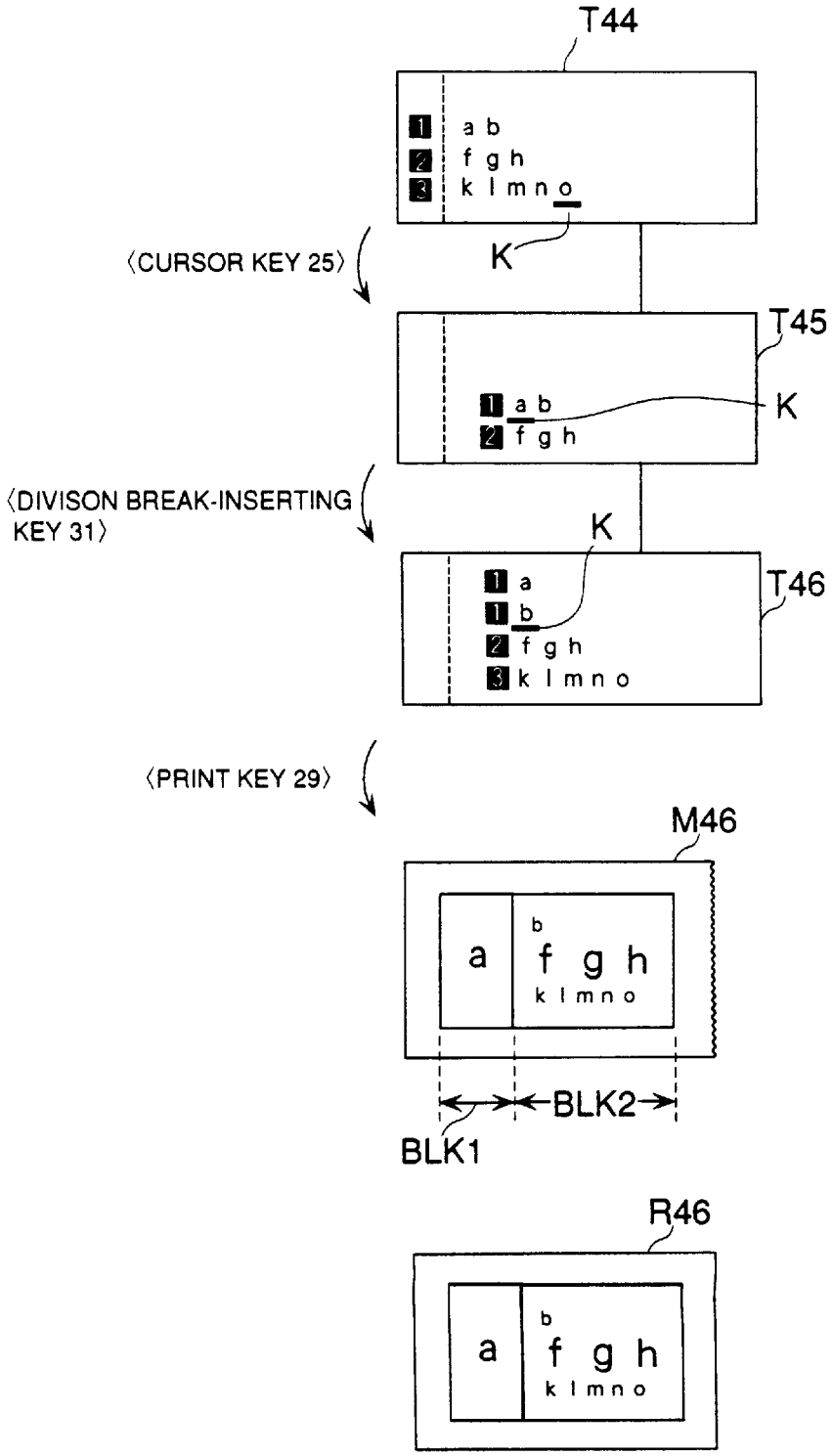

Further, as shown in FIG. 9B, assuming that a printing style "Division comprised of one line of large character size with an outer frame" is set for a first division BLK1 and a printing style "Division comprised of three lines of small, large, and small character sizes with an outer frame" is set for a second division BLK2, after alphabet characters "ab" are entered on a first line, ° alphabet characters "fgh" on a second line and alphabet characters "klmno" on a third line (T44), if the division break-inserting key 31 is depressed in the state of the cursor key 25 being placed at the alphabet character a on the first line (T45), the first division BLK1 is changed such that it contains only the alphabet character "a", while a new second division BLK2 is formed which is comprised of a first line of the alphabet character "b", a second line of the alphabet characters "fgh" and a third line of the alphabet characters "klmno" (T46). When the print key 29 is depressed, the first division BLK1 and the second division BLK2, which contain the entered characters arranged according to the printing styles, are printed on the tape T (M46), and a label R46 is obtained by cutting off the printed portion of the tape T.

Figure 10A:
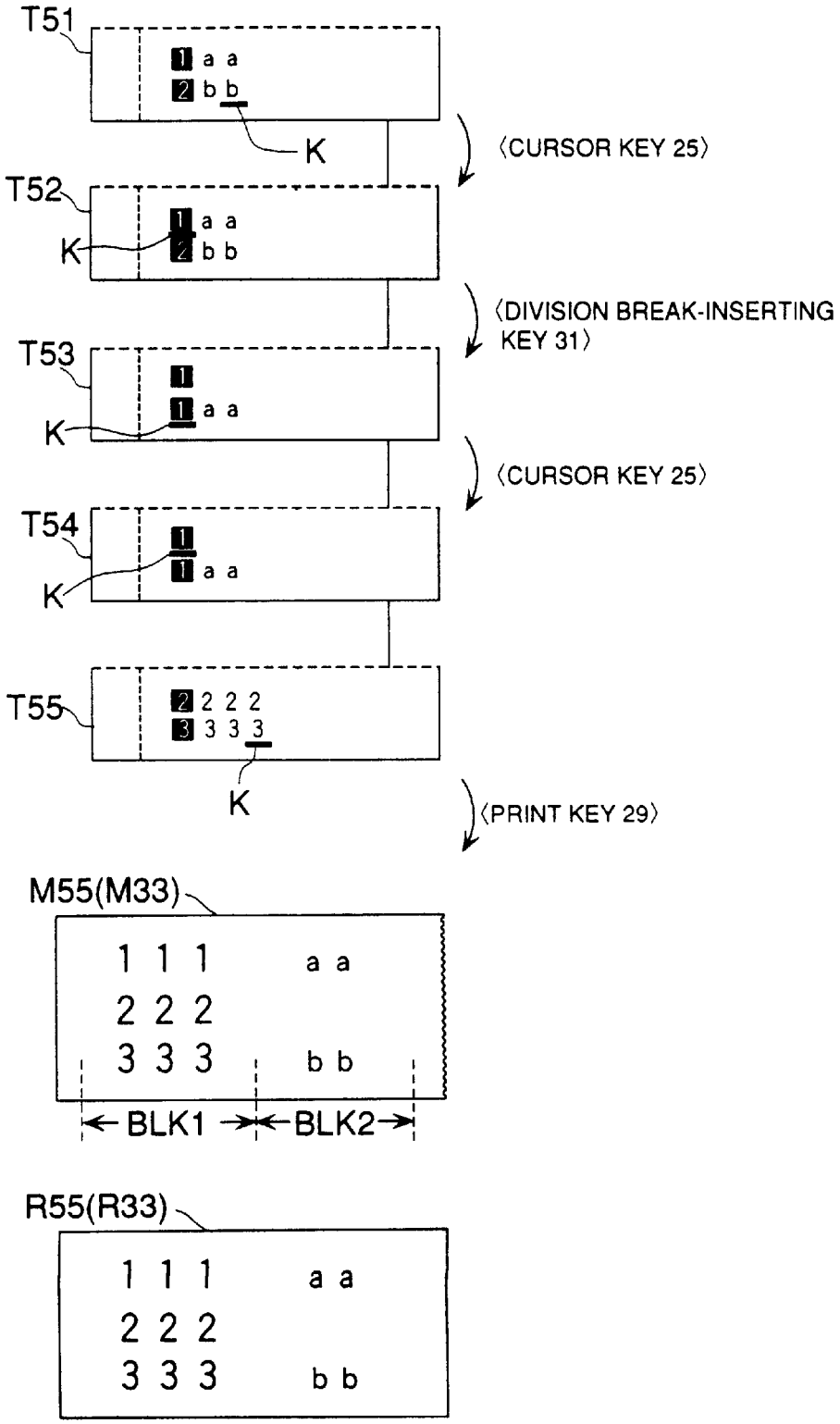
FIGS. 10*a* and 10B are diagrams similar to FIGS. 8A and 8B, showing other examples of respective sequences of screens, as well as resulting text data and print images thereof.

Next, a case where a division break is inserted at a line head of a first line of a division will be described with reference to FIGS. 10*a* and 10B. For instance, as shown in FIG. 10A, after character strings "aa" and "bb" are entered on a first line and a second line, respectively (T51), and the cursor key 25 is operated to place the cursor K at the line head (line number) of the first line of the division (T52), if the division break-inserting key 31 is depressed, a first line of a newly created division preceding the original division appears (T53). If the cursor K is moved to the line head of the preceding division (T54) to enter numerals "111" on its first line, numerals "222" on its second line, and numerals "333" on its third line (T55) and then the print key 29 is depressed, a first division BLK1 and a second division BLK2 which contain the entered characters arranged according to the printing styles are printed on the tape T (M55: identical to M33) and a label R55 (identical to R33) is obtained by cutting off the printed portion of the tape T.

Figure 10B:
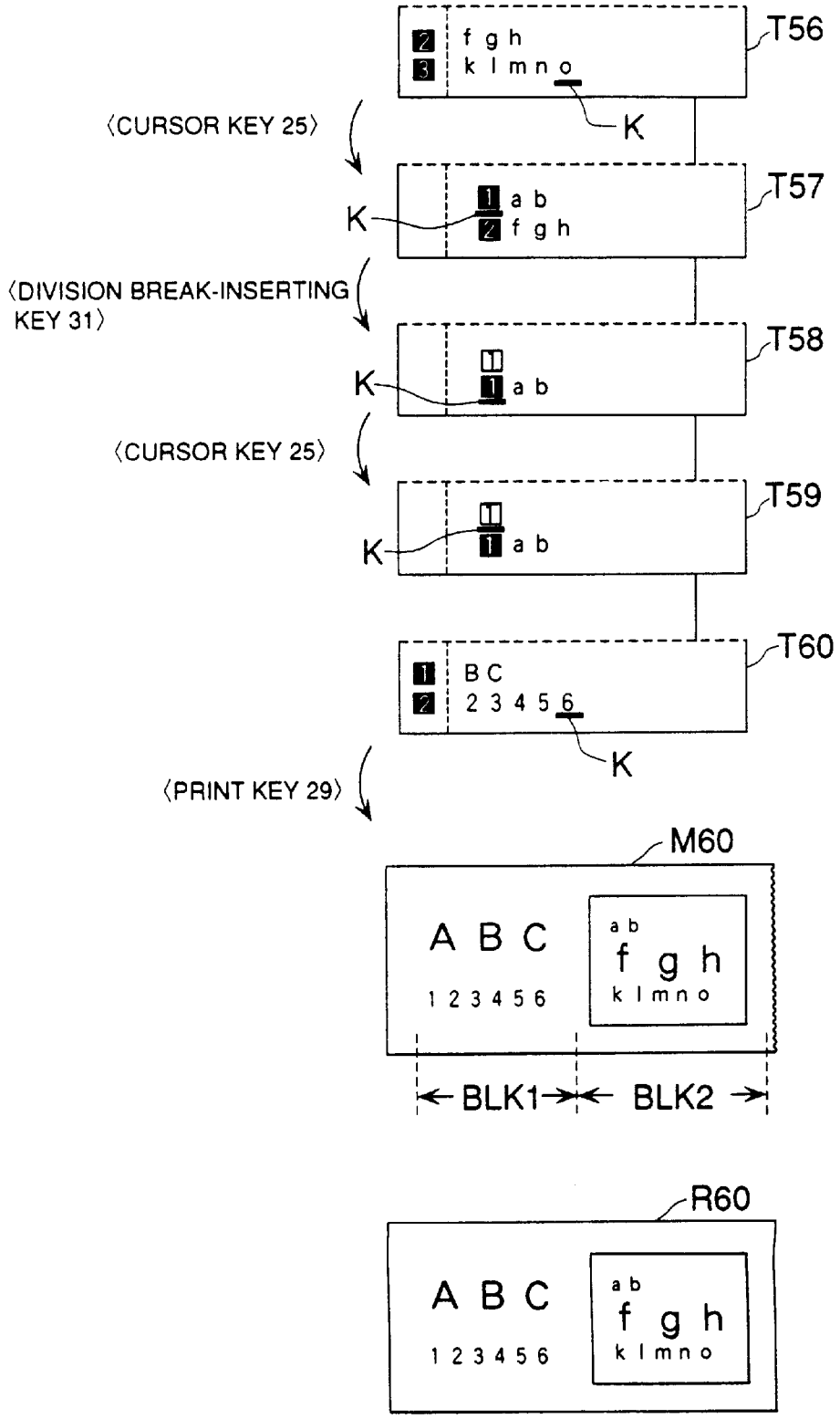

Further, a shown in FIG. 10B, assuming that a printing style "Division comprised of two lines of large and small character sizes" is set for a first division BLK1 and a printing style "Division comprised of three lines of small, large, and small character sizes with an outer frame" is set for a second division BLK2, after alphabet characters "ab" are entered on a first line, alphabet characters "fgh" are entered on a second line and alphabet characters "klmno" on a third line (T56), if the division break-inserting key 31 is depressed in the state of the cursor key 25 being placed at the line head (line number) of the first line of the first division (T57), a first line of a newly created division preceding the original division appears. If the cursor K is moved to the line head of the preceding division (T59) to enter a character string "ABC" on its first line, numerals "123456" on its second line (T60), and then the print key 29 is depressed, the first division BLK1 and the second division BLK2 which contain the entered characters arranged according to the printing styles set therefor are printed on the tape T (M60), and a label R60 is obtained by cutting off the printed portion of the tape T.

Next, the file/format-selecting/designating process (S7) will be described. Referring to FIG. 4, in the course of the display screen process (S2) for the normal print format, if the file/format key 24 is depressed, it is determined at the step S3 that a key entry has been made (Yes to S3), that the operated key is a function key (Yes to S4), that the operated function key is the file/format key 24 (Yes to S6), and then the file/format-selecting/designating process is carried out at the step S7.

It should be noted that although, once a special print format is selected and designated in the file/format-selecting/designating process (S7), the character entry process (S5) and the display screen process (S2) are also carried out for the special print format. However, the processes are not related to the present invention, and hence detailed description thereof will be omitted.

Figure 11:
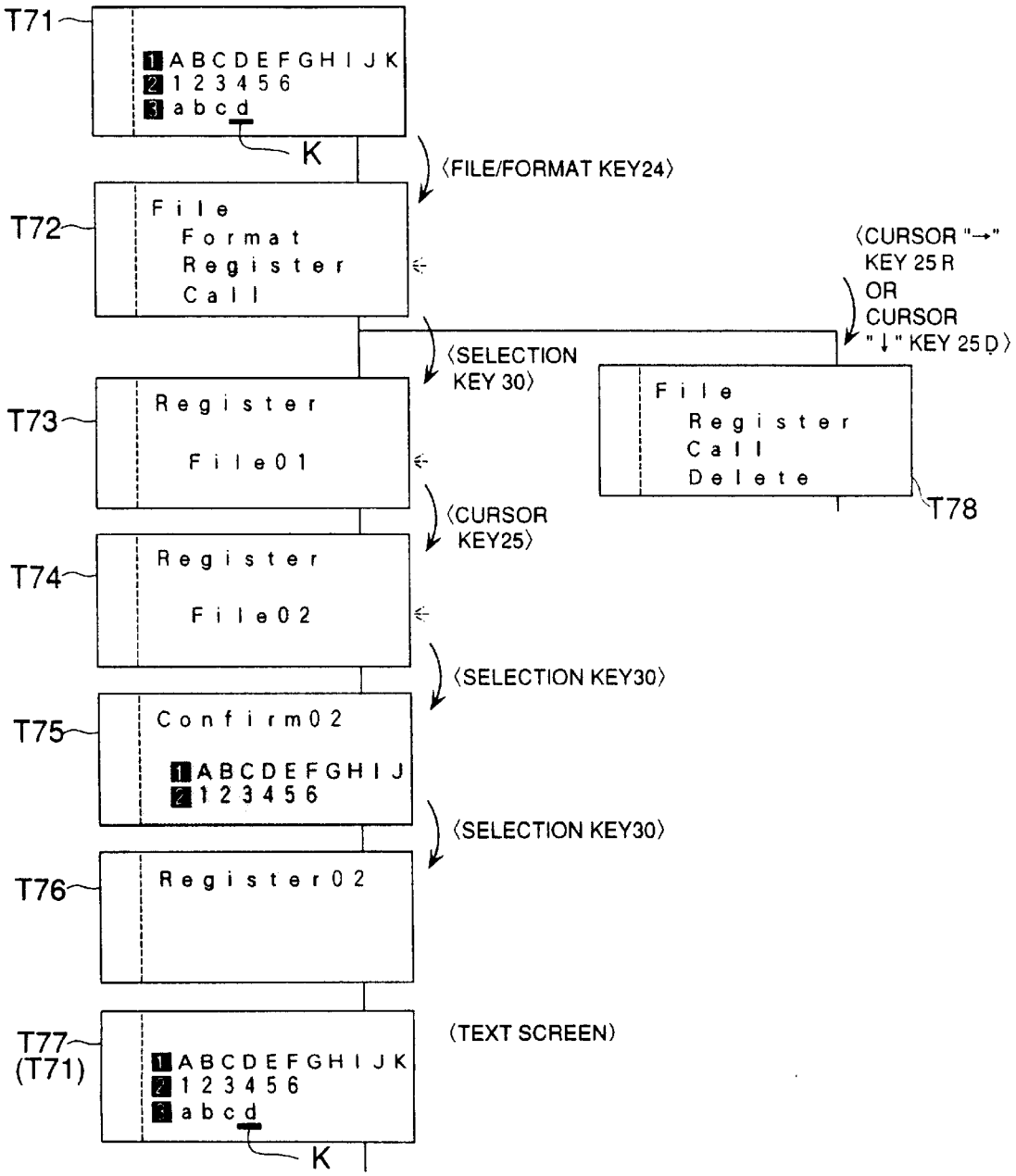
FIG. 11 is a diagram showing an example of sequence of screens displayed during a file registration operation.

Referring to FIG. 11, in the state of a text entry screen being displayed (T71) after a character string "ABCDEFGHIJKL" is entered on a first line, "123456" on a second line and "abcd" on a third line, for instance, if the file/format key 24 is depressed, it becomes possible to handle files and select print formats (T72).

That is, from the menu of six options of (1) "Special format", (2) "Format", (3) "Register",(4) "Call",(5) "Delete", and (6) "Copy", a desired one can be displayed in decorated characters (in the figure they are shown shaded by dots: hereinafter this manner of display will be referred to as "the shaded manner"), through operation of the cursor "↓" key 25D or the cursor "↑" key 25U, and then by depressing the selection key 30, an option displayed in the shaded manner can be selected for designation. In the above case, if the option (1) "Special format" is selected, a special print format can be selected from menu options for designation, whereas if the option (2) "Format" is selected, a normal print format can be selected from menu options for designation, and under the options of (3) "Register" to (6) "Copy", it is possible to select respective file-handling operations.

Although the characterizing features of the present invention consist in the option (4) "Call" among the above options of (1) to (6), before describing the same, the option (3) "Register" will be described as a prerequisite for execution of the option (4) "Call".

As shown in FIG. 11, immediately after depression of the file/format key 24, the default option of (3) "Register" is displayed in the shaded manner (T22), and by depressing the selection key 30, the option "Register" is selected (T73). It should be noted that the option of "Call", described hereinafter, can be selected for designation, if the selection key 30 is depressed after displaying the option of (4) "Call" in the shaded manner (T78) through operation of the cursor 25.

When the option "Register" is selected, an area number of a blank area which is equal to or larger than that of an area accessed the last time ("01" in the illustrated example of FIG. 11) is displayed (T73). When the cursor key 25 is operated in this state, registrable numbers of blank areas are displayed in the shaded manner one after another (T74). If the selection key 30 is depressed in a state where a desired area number ("02" in the illustrated example) is displayed in the shaded manner (T74), a confirmation screen for confirming contents of a file to be registered is displayed (T75). In the above process, if an area number (e.g. "02") is directly entered by operating number keys of the character key group 21 in the state of the screen T73, the entered area number is displayed in the shaded manner (T73).

Figure 12:
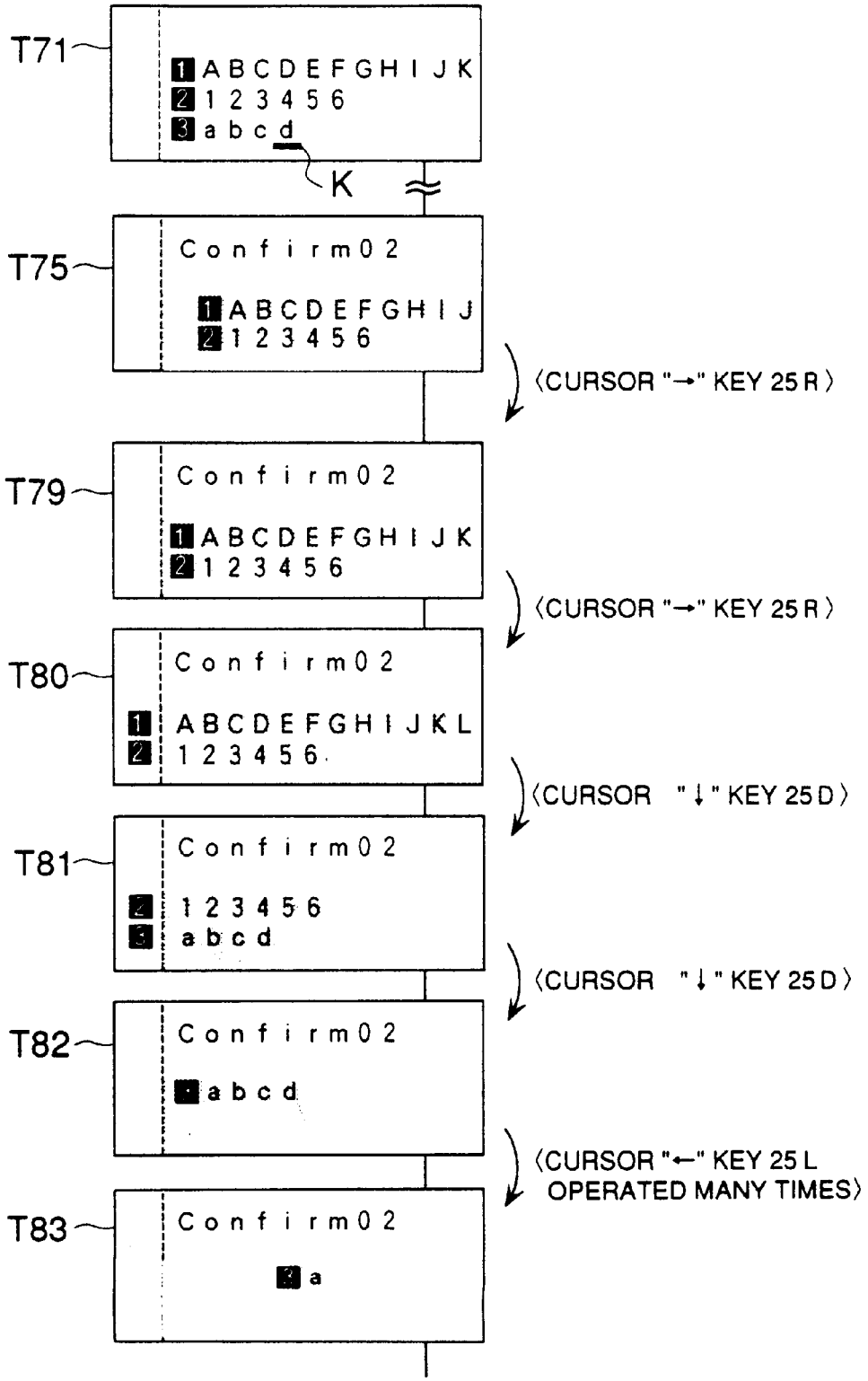
FIG. 12 is a diagram showing an example of a sequence of screens displayed on a confirmation screen during a confirming operation for confirming document data formed of text data.

After confirming the contents of text data displayed on the confirmation screen (T75: a confirming method will be described hereinbelow with reference to FIG. 12), by depressing the selection key 30, the file registration is carried out. The above text data (shown on the screen T71) is registered in the area having the designated area number selected or entered as described above in the registered document data memory 65 of the RAM 60 (T76), followed by returning to the original text screen (T77: identical to T71. Hereinafter, registered text data is referred to as "registered document", while text data being edited on the text screen is referred to as "editing document", if they are required to be distinguished from each other).

Next, the confirming method (operation) on the confirmation screen will be described with reference to FIG. 12. This confirming method (operation) is common to the above-mentioned file handling operations of (3) "Register", (4) "Call",(5) "Delete", and (6) "Copy ", although (3) "Register" is distinguished from the other file handling operations in that, when (3) "Register" is carried out, a file or document data to be confirmed is an editing document for registration, whereas when the other handling operations are carried out, a file or document data to be confirmed is a registered document for processing, and the file-handling operations of (3) to (6) are distinguished from each other in that messages displayed for confirming operations are "Register", "Call ?", "Delete ?"and "Copy ?" respectively. Now, the description will be made based on an example of the case of the option "Register" being selected as described above with reference to FIG. 11.

As described above with reference to FIG. 11, when the selection key 30 is depressed in the state where the desired area number ("02") is displayed in the shaded manner (T74), the confirmation screen is displayed (T75). On the screen T75 shown in FIG. 12 (the same screen as shown in FIG. 11), text data including line numbers is displayed with the head of the text data, i.e. the line number 1 being positioned at a location for a second character on a third line in the display screen 9*a* (see FIG. 5A). At this time, the cursor K is imaginarily placed at a fifth character (an alphabet character "C" shown in the figure) on the third line in the display screen 9*a*.

When the cursor "→" key 25R is depressed from the above state (T75), the display range is scrolled rightward (the characters are moved leftward) (T79: The cursor K is placed at an alphabet character "D"). Similarly, when the cursor "→" key 25R is further depressed, the display range is further scrolled rightward (T80: the cursor K is placed at an alphabet character "E"). In this state (T80), the first line and the second line of text data have their whole portions up to rightward line ends thereof displayed, so that when the cursor "→" key 25R is further depressed, an alarm (beep or the like) is given. It should be noted that since the first line of the text data is displayed in the state of the screen T80 and the above screen T79, when the cursor "↑" key 25U is depressed, the alarm is given in the same fashion.

When the cursor "↓" key 25D is depressed from the state of the screen T80, the display range is scrolled downward (each line is moved upward) (T81: the cursor K is placed at a numeral "5"). When the cursor "↓" key 25D is further depressed, the display range is further scrolled downward for displaying the last line of the text data on the third line of the display screen 9*a* (T82: in this case, there is no character under the numeral "5" on the second line of the text data and hence an alphabet character "d" on the third line of the text data, i.e. at the end of the text data is displayed at the position of the cursor K). In this state (T82), the end of the text data is displayed on the third line of the display screen 9*a* and when the cursors "→" key 25R or the cursor "↓" key 25D is depressed, the alarm is given.

On the other hand, inversely, e.g. after the cursor "←" key 25L is operated a lot of times for moving the line number of the last (third) line of the text data to the imaginary position of the cursor K (i.e. to a position of a fifth character on the third line in the display screen 9*a*) (T83), if the cursor "←" key 25L is further depressed, the alarm is given.

As described above, whole text data can be confirmed or viewed by scrolling the display range in which part of the text data to be confirmed is displayed. Further, since an alarm is issued if the cursor 25 is further operated when text data is displayed to a limit of the display range, the user is prevented from losing sight of the text data from the display screen when the cursor key 25 is operated a larger number of times than required.

After confirming the text data in the above manner, by depressing the selection key 30, as described above with reference to FIG. 11, the file registration is carried out (T76). Of course, if the confirming operation has been executed for one of the other file handling operations than the file registration, the program proceeds to the primary routine of each of the file handling operations.

Next, the file calling operation which constitutes characterizing features of the invention will be described with reference to FIG. 13 et seq.

Figure 13:
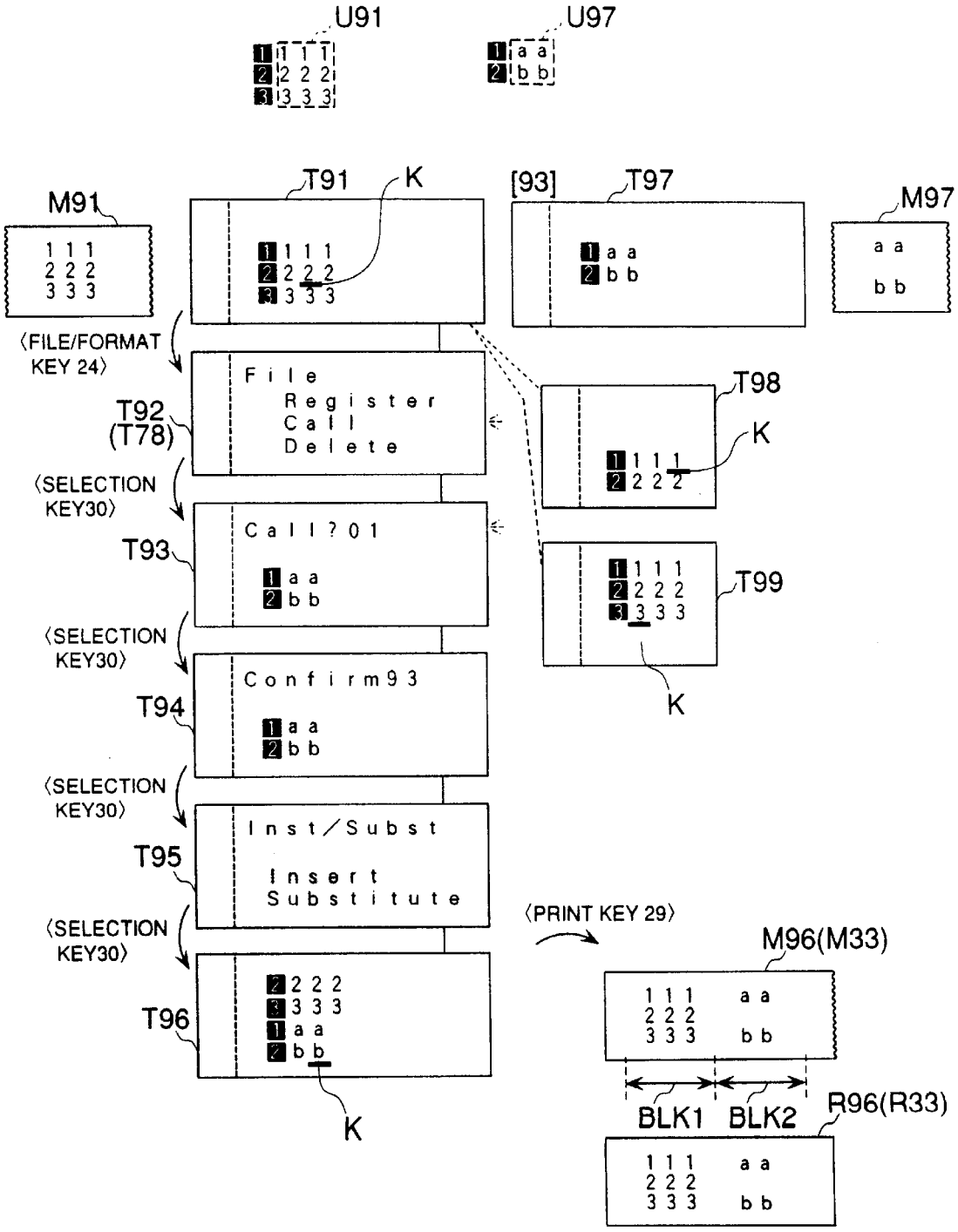
FIG. 13 is a diagram showing an example of a sequence of screens displayed during a file-calling operation carried out on an editing document using a registered document.

First, as a prerequisite for the following description, it is assumed that the text data having the alphabet characters "aa" and "bb" on the first line and the second line, respectively, which are used in explanations made with reference to FIGS. 8A to 10*a* hereinabove, is created in advance as an editing document, as shown in FIG. 13, and that the file handling operation in the file registration process, described hereinabove, is carried out for registering the text data as a registered document U97 in an area having a designated area number 93 in the registered document memory 65 of the RAM 60. In this case, reference numeral M97 in the figure indicates an image of the registered document U97 separately printed.

As shown in the figure, for instance, after entering numerals "111" on the first line, numerals "222" on the second line and numerals "333" on the third line, similarly to the case of the registered document U97, to form the same editing document as described with reference to FIGS. 8A to 10A, in short, after creating the text data U91 a separate print image of which is indicated by reference numeral M91, if the file/format key 24 is depressed in a state where the cursor K is placed at a location in the editing document U91 (T91: in the case of FIG. 13, the cursor K is placed at a second numeral "2" on the second line), the default option (3) "Register" is displayed in the shaded manner (T72 in FIG. 11) immediately after the depression of the file/format key 24, as described above. When the cursor "↓" key 25D is depressed in this state, the option (4) "Call" is displayed in the shaded manner (T92: identical to T78 appearing in FIG. 11).

When the selection key 30 is depressed in a state where the option (4) "Call" is displayed in the shaded manner, the file calling is selected for designation and a message "Call ?" is displayed, followed by an area number of an area which is equal to or larger than that of an area accessed the last time and is indicative of an area from which registered document can be called, i.e. where the registered data is stored, ("01" in the case of FIG. 13) (T93).

When the cursor key 25 is operated in the above state, the area numbers of such areas are displayed one after another, and if the selection key 30 is depressed in a state where a desired number ("93") is displayed in the shaded manner, a confirmation screen for confirming contents of a called file is displayed (T94). Also, in this process, if the area number ("93") is directly entered by operating number keys of the character key group 21, in the state of the screen T93, the area number is displayed in the shaded manner.

After confirming contents of the registered document U97 as data to be confirmed on the confirmation screen (T94) by the method described above with reference to FIG. 12, if the selection key 30 is depressed, a selection screen for selecting a calling mode for calling a file is displayed (T95). As the calling mode, there are provided a "call-and-insert mode" and a "call-and-substitute mode". After the cursor "↑" key 25U or the cursor "↓" key 25D is operated on the selection screen (T95) to display the option of (1) "Insert" for the call-and-insert mode or an option of (2) "Substitute" for the call-and-substitute mode in the shaded manner, if the selection key 30 is depressed, one of the above modes can be selected for designation.

Out of the above two calling modes, the "call-and-substitute mode" is for writing the called registered document over the editing document. If the registered document U97 is called for substitution, the resulting image is the same as shown on the screen T97 in FIG. 13 and if the resulting image is printed, the printed image is identical to the print image M97.

On the other hand, according to the file calling in the "call-and-insert mode", when the cursor K is placed in a desired division of an editing document, a registered document is called and inserted immediately after the desired division as data forming a new division. That is, the called registered document is inserted as document data forming a new division, immediately after the division containing the position designated by the cursor (position-designating means) K.

More specifically, as shown in FIG. 13, when (1) "Insert" is displayed in the shaded manner on the selection screen (T95) in the calling mode, by depressing the selection key 30, the "call-and-insert mode" is selected for designation and the file calling operation in the "call-and-insert mode" is carried out. In this process, the called registered document U97 is inserted as document data forming a new division, immediately after the division including a position designated by the cursor, that is, the division (of the editing document U91 being edited on the screen T91) formed of the numerals "111", "222" and "333" arranged on the first line, the second line and the third line, respectively (T96).

Therefore, if the print key 29 is depressed in this state (T96), the first division BLK1 and the second division BLK2 which are formed according to the above printing styles and containing the entered and inserted characters are printed on the tape T (M96: identical to M33 described hereinabove with reference to FIG. 8A) and by cutting off the printed portion of the tape T a label R96 (identical to R33 appearing in FIG. 8A) is obtained.

In the above process, the cursor (position-designating means) K may be placed at any position in the editing document U91 (e.g. at a position shown on the screen T98 or T99 in FIG. 13).

Figure 22:
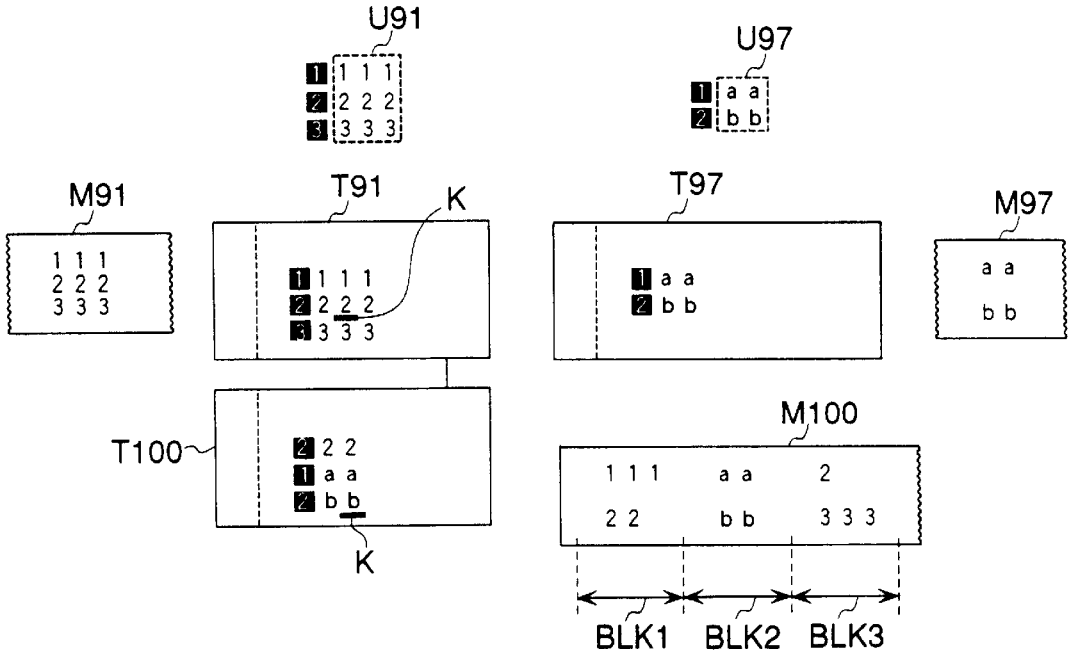
F I G. 2 2 PRIOR ART
FIG. 22 is a diagram similar to FIG. 13, which is useful in explaining a conventional manner of the file calling operation.

That is, in the conventional tape printing apparatus, if a file is called and inserted in a state where the cursor K is placed at an intermediate portion of a division, continuous contents or series of document data in the division are separated (see FIG. 22) and hence it is required to find out a breakpoint of the division on the display screen to accurately place the cursor K at the breakpoint of the division and then carry out the call-and-insert operation. According to the tape printing apparatus 1, however, it is only required that the cursor K is placed within the division.

This is true when an editing document into which a registered document is to be inserted by calling the same is comprised of a plurality of divisions. If only the cursor K is moved into a desired division, regardless of where the cursor K is placed within the division (i.e. whatever position in the division is designated by the cursor K), the called registered document is inserted as document data forming a new division, immediately after the division.

As a result, according to the tape printing apparatus1, it is possible to call and insert registered document on a division-by-division basis, without separating series of document data of a division of an editing document, even if the call-and-insert operation is carried out without much attention.

It should be noted that the present invention is not limited to the above embodiment, but it can be practiced in various forms.

For instance, although in the above embodiment, the called registered document is inserted as document data forming a new division immediately after the division including the position designated by the cursor (position-designating means) K, this is not limitative, but the called registered document can be inserted as document data forming a new division immediately before the division including the position designated by the cursor (position-designating means) K. Also, in this case, the same process as described hereinabove is carried out and hence the same advantageous effect can be obtained. That is, it is possible to call and insert a registered document on a division-by-division basis without separating continuous contents or series of document data of each division of an editing document, even if the call-and-insert operation is carried out without much attention.

Further, the tape printing apparatus 1 may be configured such that a predetermined area is defined or set by a predetermined definition in a desired division of an editing document and when a position designated by the cursor (position-designating means) K is in the predetermined area, a registered document is called and inserted immediately before or immediately after the division containing the designated position.

In the following, various examples of the method of designating an inserting position and other designating methods will be described with reference to FIG. 14A et seq.

Figure 14A:
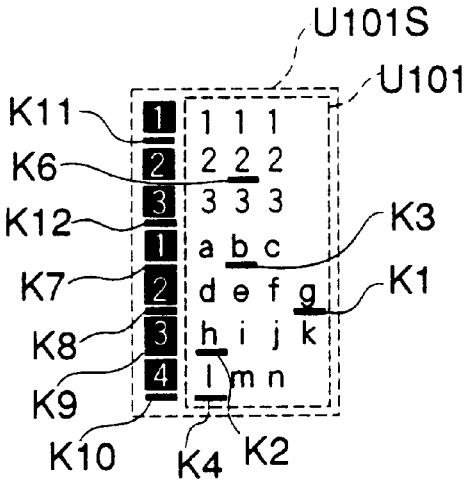
FIG. 14A is a diagram showing an example of an image of a display screen presenting a display image of an original editing document before execution of a file-calling operation together with possible cursor positions, which is useful in explaining methods of designating a position at which a called file should be inserted.
Figure 14B:
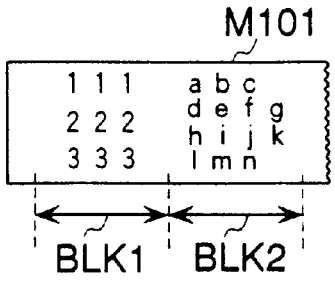
FIG. 14B is a diagram showing a print image formed by printing the editing document separately.
Figure 14C:
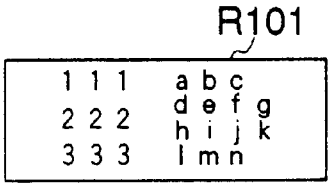
FIG. 14C is a diagram showing an image of a label bearing the FIG. 14B print image.

Referring to FIGS. 14A to 14C, let it be assumed that there is an editing document item U101 comprised of a first division BLK1 containing a first line of numerals "111", a second line of numerals "222" and a third line of numerals "333" and a second division BLK2 containing a first line of alphabet characters "ABC", a second line of alphabet characters "defg", a third line of alphabet characters "hijk" and a fourth line of alphabet characters "lmn", and that the registered document U97 described above with reference to FIG. 13, which contains the first line of alphabet letters "aa" and the second line of alphabet letters "bb", is called and inserted into the editing document item U101. Hereinafter, a document data item formed of document data U??? and line number data associated therewith will be referred to as document data U???S and indicated by the same reference numeral in FIG. 14A et seq.

In the above case, if the editing document U101 is separately printed, a print image M101 shown in FIG. 14B is formed, and by cutting off the printed portion of the tape T, a label R101 shown in FIG. 14C can be obtained.

Figure 15A:
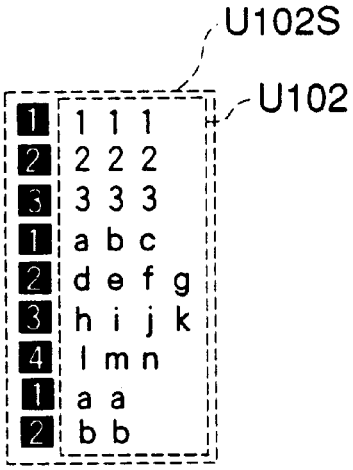
FIG. 15A is a diagram showing an example of an image of a display screen presenting a display image of an editing document formed by calling and inserting a registered document into the FIG. 14A editing document.
Figure 15B:
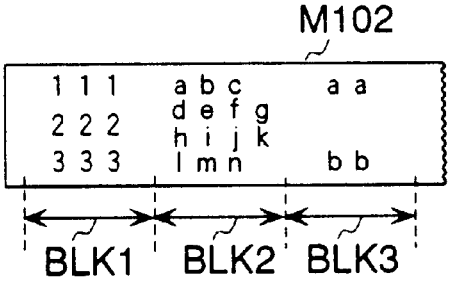
FIG. 15B is a diagram showing a print image of the FIG. 15A editing document.
Figure 15C:
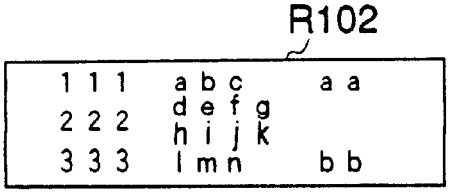
FIG. 15C is a diagram showing an image of a label bearing the FIG. 15B print image.

When the called registered document U97 is inserted immediately after the second division BLK2 of the above editing document U101, an editing document U102 shown in FIG. 15A is formed (M102 in FIG. 15B designates a print image thereof and R102 in FIG. 15C a label being the print image).

Figure 16A:
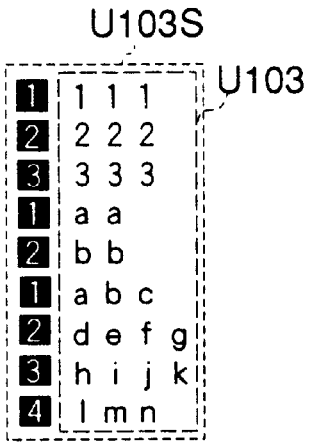
FIGS. 16A to 16C are diagrams similar to FIGS. 15A to 15C, showing another example of an editing document formed by calling and inserting a registered document into the FIG. 14A editing document, a print image of the formed editing document, and a label bearing the print image, respectively.
Figure 16B:
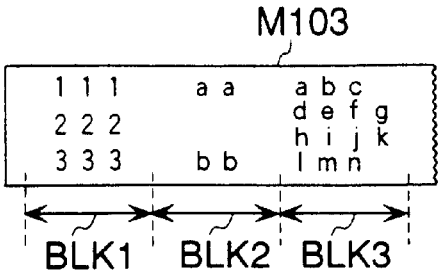
Figure 16C:
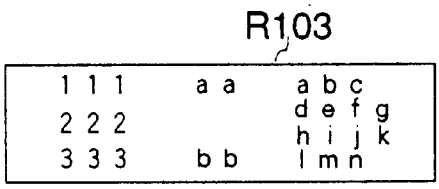
Figure 17A:
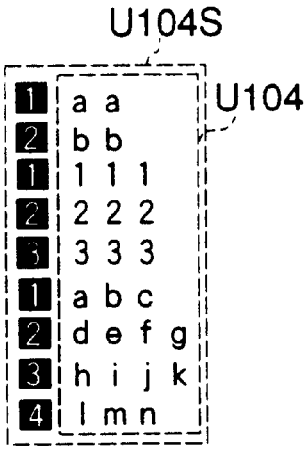
FIGS. 17A to 17C are diagrams similar to FIGS. 15A to 15C, showing still another example of an editing document formed by calling and inserting a registered document into the FIG. 14A editing document, a print image of the formed editing document, and a label bearing the print image, respectively.
Figure 17B:
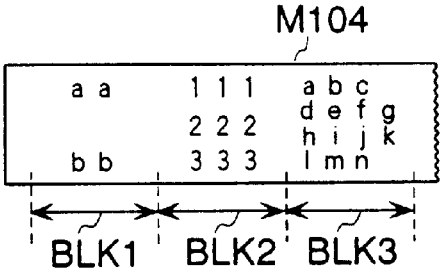
Figure 17C:
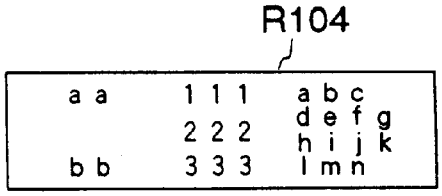

Similarly, if the called registered document U97 is inserted between the first division BLK1 and the second division BLK2 of the editing document U101, an editing document U103 shown in FIG. 16A is formed (M103 in FIG. 16B designates a print image and R103 in FIG. 16C a label bearing the printing image). When the called registered document U97 is inserted immediately before the first division BLK1, an editing document U104 shown in FIG. 17A is formed (M104 in FIG. 17B designates a print image and R104 in FIG. 17C a label bearing the print image).

For instance, assuming that it is defined in advance that if a position designated by the cursor K is in an area of a first half of each division, the called registered document U97 is inserted immediately before the division, whereas if the position designated by the cursor K is in an area of a second half of the division, the called registered document U97 is inserted immediately after the division, if a position K1 appearing in FIG. 14A is designated by the cursor K, the editing document U103 described above with reference to FIG. 16A is formed by calling and inserting the registered document U97, since the designated position K1 is "in the area of the first half" of the division containing the position K1, whereas if a position K2 appearing in FIG. 14A is designated by the cursor K, the editing document U102 shown in FIG. 15A is formed, since the designated position K2 is "in the area of the second half" of the division containing the designated position K2.

Hereinafter, an area, such as the above "area of the first half of the division", defined to receive a registered document immediately before the division if the registered document is called with the cursor K designating a position within the area will be referred to as a "forward insertion-designating area". Similarly, an area, such as the above "area of the second half of the division", defined to receive a registered document immediately after the division if the registered document is called with the cursor K designating a position within the area will be referred to as a "backward insertion-designating area". An area that inhibits a registered document from being inserted if the registered document is called with the cursor K designating a position within the area will be hereinafter referred to as an "insertion inhibition-designating area", and detailed description thereof will be made hereinbelow.

According to these definitions, the "call-and-insert mode" in the embodiment described above with reference to FIG. 13 corresponds to an example in which the whole area of each division is defined as a "backward insertion-designating area".

In another example, e.g. if the first line of each division is defined beforehand as a forward insertion-designating area and the last line of each division is defined as a backward insertion-designating area, a position K3 appearing in FIG. 14A designated by the cursor K designates the forward insertion-designating area and hence the editing document U103 as shown in FIG. 16 will be created, whereas a position K4 appearing in FIG. 14A designated by the cursor K designates the backward insertion-designating area, and hence the editing document U102 shown in FIG. 15A will be created.

Further, although in the above example, both a forward insertion-designating area and a backward insertion-designating area are defined, this is not limitative, but only one of the forward and backward insertion-designating areas can be defined. For instance, if the first line of each division is defined as the forward insertion-designating area, the other area can be automatically defined as the backward insertion-designating area. Still further, in this case, it is also possible to define only the forward insertion-designating area for determining the other area as the insertion inhibition-designating area. Similarly, when only the backward insertion-designating area is defined, the other area can be defined as the forward insertion-designating area or the insertion inhibition-designating area.

Therefore, now, an example of defining the insertion inhibition-designating area will be described hereinafter. First, as described above, when only one of the forward insertion-designating area and the backward insertion-designating area is defined, the other area can be defined as the insertion inhibition-designating area. Further, in the above case where the first line of each division is define as the forward insertion-designating area and the last line thereof is defined as the backward insertion-designating area, as shown in FIG. 14A, the numerals "222" on the second line of the first division BLK1, the alphabet characters "def g" on the second line of the second division BLK2 and the alphabet characters "hijk" on the third line of BLK2 do not belong to the forward insertion-designating area or the backward insertion-designating area. Therefore, these lines may be defined as an insertion inhibition-designating area.

Further, when a division is divided into a first half and a second half, K6, for instance, at a location at the second character "2" on the second line of the first division BLK1 in FIG. 14A is a location which is impossible to determine whether it belongs to the first half of the division or the second half of the same, unless otherwise additionally defined. Therefore, such a position as K6 may be defined as an insertion inhibition-designating area.

Next, a process carried out when the insertion inhibition-designating area is defined (e.g. when the above position K6 is defined as a position in the insertion inhibition-designating area) will be described with reference to FIG. 18. In the figure, a sequence of operations carried out on the screens T111 to T114 are the same as ones performed on the screens T91 to T94 described above with reference to FIG. 13, and hence detailed description thereof is omitted.

Figure 18:
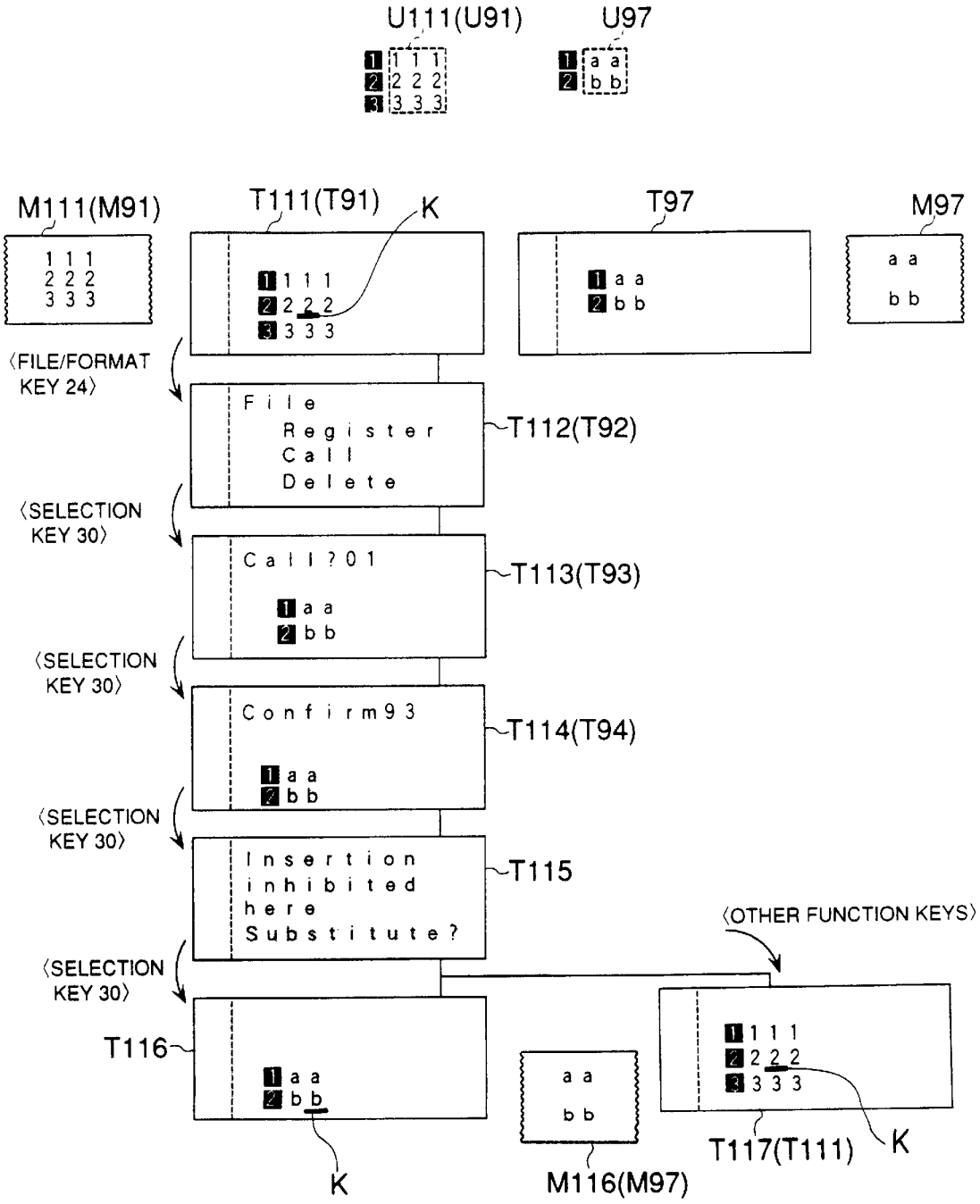
FIG. 18 is a diagram showing an example of sequences of screens displayed when a file is called for insertion at a position where insertion of called data is inhibited.

As shown in FIG. 18, when the file/format key 24 is depressed in the above state (T111), the file/format-selecting/designating process (S7 shown in FIG. 4) is started. After carrying out a selection operation (T112 to T113) and then confirming the contents of registered document U97 on the confirmation screen (T114), if the selection key 30 is depressed, instead of displaying the selection screen (see the screen T95 in FIG. 13) in the file calling mode, an alarm message ""Insertion inhibited here" appears on the display screen and at the same time a message "Substitute ?" is displayed in the shaded manner (T115), which prompts the user to effect a key entry answering a question as to whether or not a call-and-substitute operation is to be carried out.

If the selection key 30 is depressed in the above state (T115), "the call-and-substitute mode" is selected and a substitute process is carried out to replace the current editing document by the registered document U97. However, the selection can be canceled by depressing another key to return to the immediately preceding state (T117: identical to T111). That is, the message "Insertion inhibited here" is displayed in the screen T115 and at the same time the call-and-insert is disabled, whereby continuous contents of each division of an editing document are prevented from being separated due to insertion of called registered document U97 at the position of the cursor K.

As described above, when the forward insertion-designating area is set in each division, by designating a position in this area by the cursor (position-designating means), a called registered document can be inserted immediately before the division. In this case, whatever location in the area may be designated by the cursor (position-designating means), the called registered document can be inserted immediately before the division containing the designated position as document data forming a new division, so that it is possible to call and insert the registered document on a division-by-division basis, without separating continuous contents of each division of the editing document, even if the call-and-insert operation is carried out without much attention.

Further, in the above case, if the area other than the forward insertion-designating area is defined as the backward insertion-designating area, by designating a position in this area by the cursor, the called registered document can be inserted immediately after the division including the designated area as document data forming a new division. Further, whichever position in the whole area of the division may be designated by the cursor, the called registered document can be inserted immediately before or immediately after the division, which makes it possible to prevent the separation of continuous contents of each division of the editing document. Furthermore, if the area other than the forward insertion-designating area is defined as the insertion inhibition-designating area, insertion of registered document is inhibited when this area is designated by the cursor, which makes it possible to prevent continuous contents of each division of the editing document from being separated.

Further, when the backward insertion-designating area is defined in each division, by designating a position in this area by the cursor (position-designating means), a called registered document can be inserted immediately after the division, and whatever position in the area may be designated by the cursor (position-designating means), the called registered document can be inserted as document data forming a new division, so that it is possible to obtain the same advantageous effects as obtained by setting the above forward insertion-designating area.

Similarly, if the area other than the backward insertion-designating area is automatically defined as a forward insertion-designating area, whichever position in the whole area of the division may be designated, the called registered document can be inserted immediately before or immediately after the division, which makes it possible to prevent the separation of continuous contents of each division of the editing document. If the area other than the backward insertion-designating area is defined as the insertion inhibition-designating area, the called registered document is prevented from being inserted when the cursor is positioned within this area, which makes it possible to prevent the separation of continuous contents of each division of the editing document.

Further, when the insertion inhibition-designating area is defined in each division, a called registered document is prevented from being inserted when this area is designated by the cursor, which makes it possible to prevent the separation of continuous contents in the area. In this case, if the other area(s) other than the insertion inhibition-designating area is/are defined as the forward insertion-designating area and/or the backward insertion-designating area, by designating a position in the area(s), the called registered document can be inserted immediately before or after the division including the area(s). Further, if the whole area of each division is included in any of the designated areas, it is possible to prevent the separation of continuous contents of each division of an editing document.

When the forward insertion-designating area and the backward insertion-designating area are set in each division, by designating a position in the areas, a called registered document can be inserted immediately before or after the division containing the areas. In this case, whatever position in the areas may be designated by the cursor (position-designating means), the called registered document can be inserted as document data forming a new division, immediately before or immediately after the division containing the designated position, so that it is possible to insert the called registered document on a division-by-division basis, without separating continuous contents of each division of the editing document, even if the call-and-insert operation is carried out without much attention. Further, if the area other than the forward and backward insertion-designating areas is defined as the insertion inhibition-designating area, the called registered document is prevented from being inserted when the area other than these is designated by the cursor, which makes it possible to prevent the separation of continuous contents of each division of an editing document.

Referring again to FIG. 14A, when a registered document is inserted into the editing document U101S having line number data added thereto, the above designated areas can also be defined based on the difference between the line number data and character data, such as letters, of the editing document U101S.

More specifically, first, it is possible to simply define a line number data area as the forward insertion-designating area and a character data area as the backward insertion-designating area. In this process, e.g. when any of positions K1 to K4 appearing in FIG. 14A is designated, the backward insertion-designating area is designated so that the editing document U102S as shown in FIG. 15A is produced, whereas when any of positions K7 to K10 appearing in FIG. 14A is designated, the forward insertion-designating area is designated so that the editing document U103S as shown in FIG. 16 is produced. It should be noted that in these cases, the document data is formed of character data alone, so that printing of the editing document U102S and the editing document U103S produces the print images M102 and M103, respectively. By cutting off the printed portions of the tape T, the labels R102 and R103 bearing the respective print images M102 and M103 can be obtained.

Further, to completely prevent character data from being separated in each line thereof, the character data areas may be defined as the insertion inhibition-designating area, whereas only the line number data area may be defined as the forward insertion-designating area or the backward insertion-designating area. For instance, it is possible to define the first half of the line number data area as the forward insertion-designating area and the second half of the line number data area as the backward insertion-designating area.

More specifically, when one of the positions K7 and K8 appearing in FIG. 14A is designated, the forward insertion-designating area is designated and hence the resulting data is the editing document U103S shown in FIG. 16A (which provides M103, R103), whereas when one of the positions K9 and K10 in FIG. 14A is designated, the backward insertion-designating area is designated and hence the resulting data is the editing document shown in FIG. 15A U102S (which provides M102, R102).

Further, a position of line number data on the first line (i.e. line number=1) of each division and that of line number data on the last line of each division may be defined as the forward insertion-designating area and the backward insertion-designating area, respectively, while the area other than the forward and backward insertion-designating areas may be defined as the insertion inhibition-designating area.

More specifically, when the position K10 appearing in FIG. 14A is designated, the backward insertion-designating area in the second division BLK2 is designated and hence the editing document U102S shown in FIG. 15A is produced, whereas when positions K7 and K12 in FIG. 14A are designated, the backward insertion-designating area of the first division BLK1 and the forward insertion-designating area of the second division BLK2 are designated, respectively, and hence the editing document U103S shown in FIG. 16A is produced, whereas when the position K11 in FIG. 14A is designated, the forward insertion-designating area of the first division BLK1 is designated, and hence the resulting data is the editing document U104S shown in FIG. 17A (which provides, M104, R104).

Of course, it may be also configured such that the designation of a position in line number data designates only the forward insertion-designating area or only the backward insertion-designating area, as described above. Further, the other designated area may be defined as the backward insertion-designating area or the forward insertion-designating area, respectively, according to the above designation or may be defined as the insertion inhibition-designating area.

As described above, by including line number data in an editing document as data to be processed for position designation, a position in the line number data and a position in the character data can be used for respective different purposes even if they are on the same line. This J enables various kinds of position-designating operations to be contrived, which makes it easy to prevent the separation of continuous contents of each division of an editing document.

Further, in addition to designation of a position in line number data and designation of a position in character data, it is possible to carry out position designation on a line-by-line basis. In this case, similarly to the above-mentioned designating methods, a first half of each line and a second half of the same can be defined as the forward insertion-designating area and the backward insertion-designating area, respectively, or only one of the two halves can be defined as one of the forward and backward insertion-designating areas to determine the other portion as the other insertion-designation area or the insertion inhibition-designating area. Alternatively, it is possible to define both of the portions except an intermediate portion therebetween as the forward and backward insertion-designating areas, respectively, while defining the insertion inhibition-designating area at the intermediate portion of the division.

Figure 19:
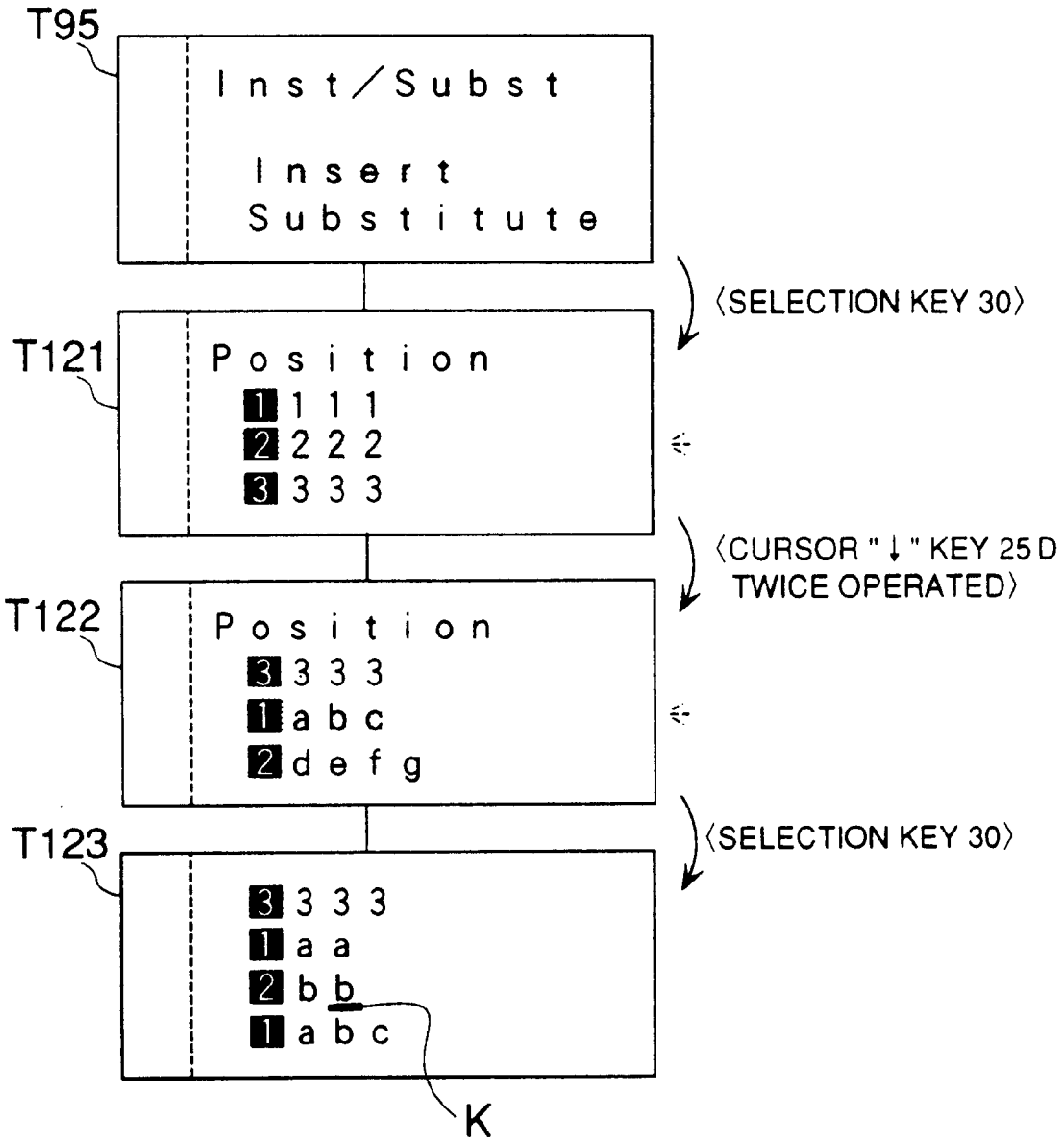
FIG. 19 is a diagram showing an example of a sequence of screens displayed when a file is called for designation of a file insertion position on a line-by-line basis during a call-and-insert operation.

In the case of the position-designating operation effected on a line-by-line basis, a method of defining a line where the cursor should be placed as one of the above designated areas on a line-by-line basis i.e. a method shown in FIG. 19 can be adopted in a more specific form. As shown in the figure, when the option (1) Insert is displayed in the shaded manner on the selection screen (T95: identical in FIG. 13) in the calling mode, by depressing the selection key 30, the "call-and-insert mode" is selected for designation. Now, differently from the case of FIG. 13, first, a screen (Inserting position selection menu screen) for prompting the user to select an insertion position is displayed (T121).

In the above state, first, part of the editing document U101 shown in FIG. 14A, for instance, is displayed together with a message "Position" with the second line of the first division BLK1 shaded (T121). From this state, the cursor "↑" key 25U or the cursor "↓" key 25D can be operated to select a desired line for designation i.e. display in the shaded manner.

Now, assuming that the first line of the second division BLK2 is defined to belong to the forward insertion-designating area, an example of designating the line will be described.

When the cursor "↓" key 25D is depressed twice from the above state (T121), the first line (comprised of "abc") of the second division BLK2 is displayed in the shaded manner (T122). Next, when the selection key 30 is depressed, the forward insertion-designating area of the second division BLK2 is designated so that the called registered document U97 is inserted immediately before the second division BLK2 to display the screen with the cursor K positioned at the end of the inserted text data (T123). Of course, the editing document displayed on the screen T123 is identical to the editing document U103 in FIG. 16A to (which provides M103 and R103).

As described above, it is also possible to carry out the position-designating operation on a line-by-line basis. Also, in this case, a called registered document is inserted similarly to the cases where the other designating methods are employed, and hence the same advantageous effects as obtained by the other designating methods can be obtained. That is, it is possible to call and insert the registered document without separating continuous contents of each division of an editing document, even if the call-and-insert operation is carried out without much attention.

Still further, it is possible to carry out a position-designating operation on a division-by-division basis in addition to the above position-designating operations.

Figure 20:
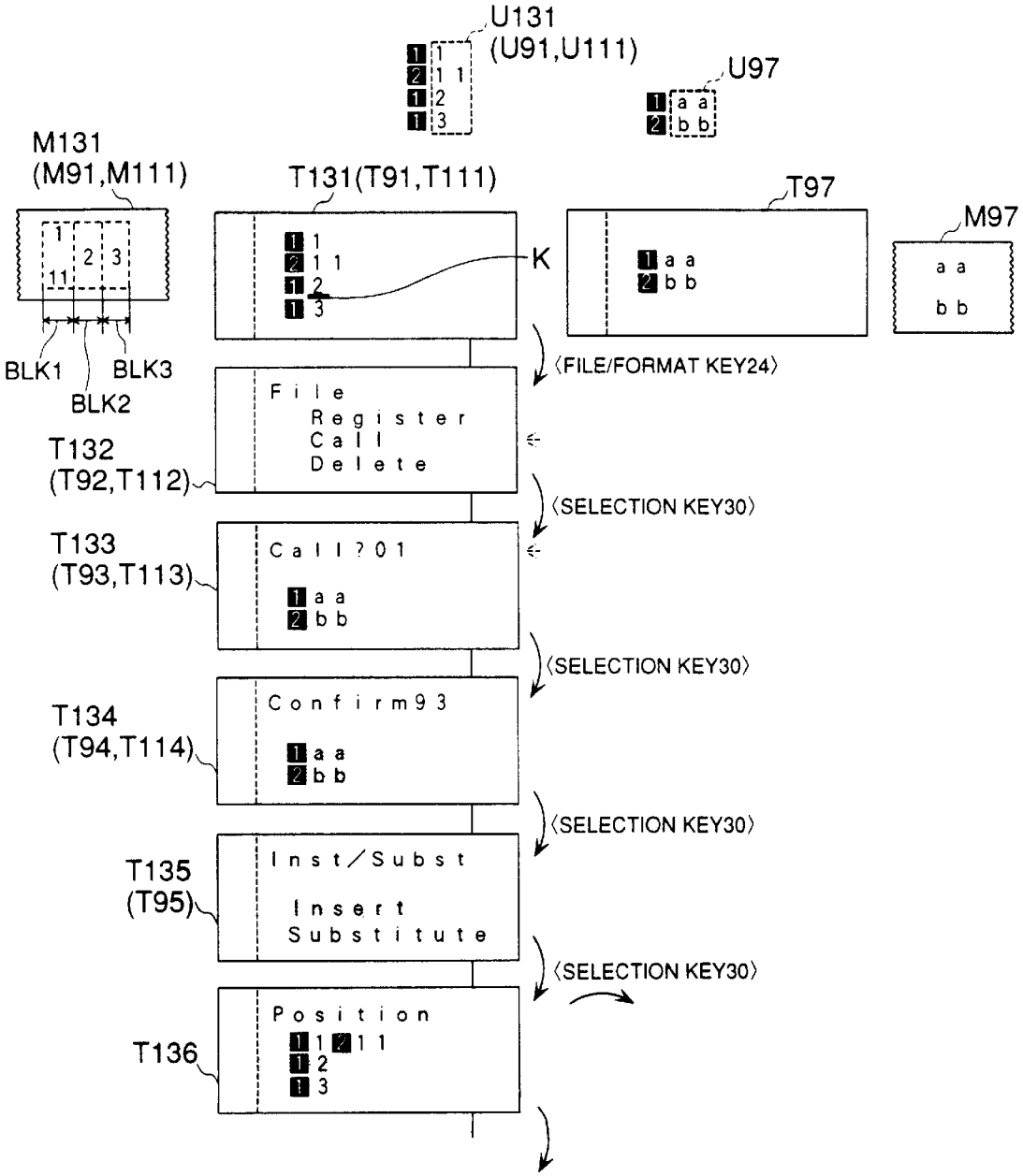
FIG. 20 is a diagram showing an example of a sequence of screens displayed when a file is called for designation of a file insertion position on a division-by-division basis during a call-and-insert operation.

More specifically, as shown FIG. 20, first, let it be assumed that the registered document U97 described hereinbefore with reference to FIG. 13 or the like is registered, and that similarly to the editing document U91 appearing in FIG. 13, there has been prepared, as an editing document, text data U131 comprised of a numeral "1" entered on the first line of the first division BLK1, numerals "11" entered on the second line thereof, a numeral "2" entered on the single line of the second division BLK2 and a numeral "3" entered on the single line of a third division BLK3, which forms a print image M131 when separately printed.

If the file/format key 24 is depressed in a state where the cursor K is positioned at any location within the editing document U131 (T131: corresponding to T91 in FIG. 13, with the cursor K being positioned at the numeral "2" in the second division BLK2 in the figure), the file/format-selecting/designating process (S7 in FIG. 7) is started. After carrying out a selection operation to confirm the contents of the registered document U97 on the confirmation screen (T132 to T134: corresponding to T92 to 94 in FIG. 13 and T112 to T114 in FIG. 18), and selecting the option (1) "Insert" to be displayed in the shaded manner on the selection screen (T135: corresponding to T95 in FIG. 13) in the file calling mode, if the selection key 30 is depressed, the inserting position menu screen on which a division can be designated is displayed (T136: corresponding to T121 in FIG. 19).

In this state, first, together with the message "Position", part of the editing document U131 is displayed with each division being shown in a line, and a line where the cursor is positioned (line of "2" forming the second division BLK2 in the illustrated example) is displayed in the shaded manner (T136). From this state, by operating the cursor "↑" key 25U or the cursor "↓" key 25D, a desired line is selected for designation to be displayed in the shaded manner.

Figure 21:
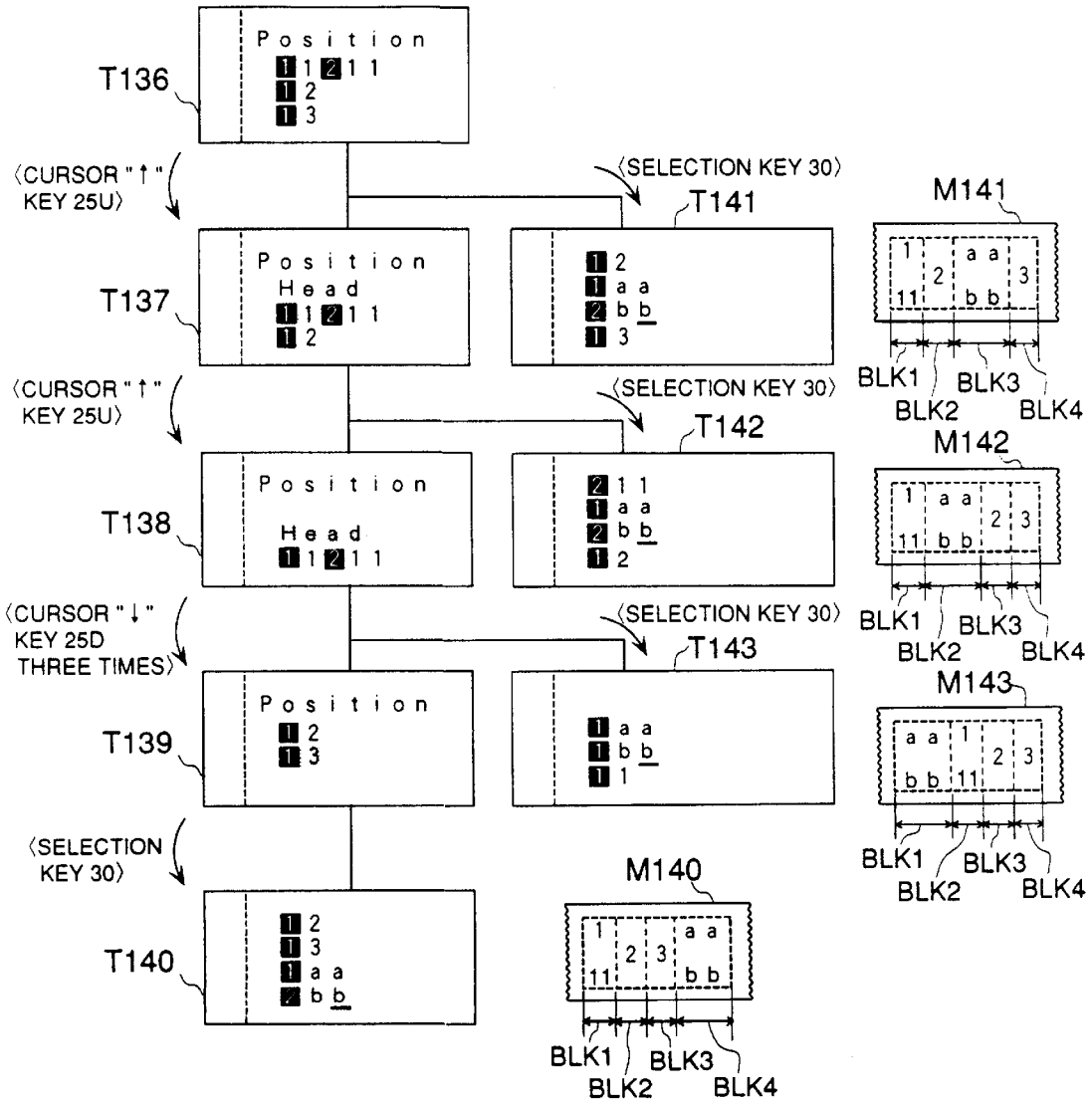
FIG. 21 is a diagram continued from FIG. 20.

As shown in FIG. 21, if the selection key 30 is depressed in a state where the above line of "2" forming the second division BLK2 is displayed in the shaded manner (T136: identical to that in FIG. 20), a location immediately after the second division BLK2 is designated and the registered document U97 is called and inserted thereat. Then, the resulting editing document is displayed with the cursor K positioned at the end of the inserted text data (T141). If this editing document is printed, a print image M141 is formed.

On the other hand, if the cursor "↑" key 25U is depressed from the above state to display the first division BLK1 in the shaded manner for designation (T137) and then the selection key 30 is depressed, a location immediately after the first division BLK1 is designated to call and insert the registered document U97 thereat (T142). If the resulting editing document is printed, a print image M142 is formed.

Further, if the cursor "↑" key 25U is depressed from the above state (T137) to display an option "Head" in the shaded manner for designation (T138) and the selection key 30 is depressed, a location immediately before the first division BLK1 is designated to call and insert the registered document U97 thereat (T143). If the resulting editing document is printed, a print image M143 is formed.

Similarly, if the third division BLK3 Is displayed in the shaded manner for designation (T139) and the selection key 30 is depressed, a location immediately after the third division BLK3 is designated to call and insert the registered document U97 thereat (T140). If the resulting editing document is printed, a print image M140 is formed.

As described above, position designation can also be executed on a division-by-division basis. Also, in this case, a registered document is called and inserted similarly to the cases where the other designating methods described above are employed, and hence the same advantageous effects as obtained by the other designating methods can be obtained. That is, it is possible to call and insert the registered document on a line-by-line basis without separating continuous contents of each division of the editing document, even if the call-and-insert operation is carried out without much attention.

Although the FIG. 4 control process is described by incorporating processes responsive to key entries therein since it is the easiest way of describing the control process, this is not limitative, but it goes without saying that the same control process can be realized through other techniques, such as task interrupt handling responsive to key entries and multitasking control of independent programs for respective different processes.

Further, although in the above embodiments the invention is applied to a tape printing apparatus of a thermal head type, this is not limitative, but a tape printing apparatus of an ink let type may be employed, and further, the thermal head type can be of various types, including a sublimation transfer type in which sublimation of ink is effected by using heating elements of thermal heads, a melting transfer type, etc. Furthermore, it goes without saying that as a tape fed from a tape cartridge, there may be employed not only a peel-off paper-backed adhesive tape but also a tape without using a peel-off paper, such as a transfer tape and an iron print transfer tape, which are commercially available.

Furthermore, the idea of insertion of called registered document according to the invention can be applied to an electronic apparatus other than the tape printing apparatus, which also has a small-sized display screen, such as a small-sized stamp making apparatus.

As described above, according to the tape printing apparatus of the invention, it is possible to call and insert registered document on a division-by-division basis, without separating continuous contents of each division of an editing document, even if the call-and-insert operation is carried out without much attention.

It is further understood by those skilled in the art that the foregoing is a preferred embodiment of the invention, and that various changes and modifications may be made without departing from the spirit and scope thereof.

What is claimed is:

1. A tape printing apparatus comprising:

input means for inputting document data including character data, line feed data, and division break-inserting data;

display means for displaying an editing document formed of said document data;

registration means for registering said editing document as one of a plurality of registered documents;

storage means for storing at least one of said registered documents;

position-designating means for designating a position within said editing document;

insertion means for calling a selected one of said registered documents and inserting the called selected one of said registered documents into said editing document as document data forming a new division of said editing document, at a predetermined one of a forward position immediately before a desired division within said editing document and a backward position immediately after said desired division, said desired division containing said position designated by said position-designating means; and printing means for printing said editing document or any of said registered documents on a tape.

2. A tape printing apparatus according to claim 1, including designation area-defining means for defining at least one of three kinds of designation areas consisting of a forward insertion-designating area, a backward insertion-designating area, and an insertion inhibition-designating area, for each division of said editing document, and wherein said insertion means includes:

forward insertion means for inserting the called selected one of said registered documents at said forward position immediately before said desired division when the designated position is within said forward insertion-designating area of said desired division;

backward insertion means for inserting the called selected one of said registered documents at said backward position immediately after said desired division when the designated position is within said backward insertion-designating area of said desired division; and insertion inhibiting means for inhibiting insertion of the called selected one of said registered documents when the designated position is within said insertion inhibition-designating area of said desired division.

3. A tape printing apparatus according to claim 2, wherein said designation area-defining means includes automatic defining means for defining the remaining area of a division of said editing document for which at least of said three kinds of designating areas is defined, as a predetermined one of the remaining two kinds of said designating areas other than said at least one of said three kinds of designating areas.

4. A tape printing apparatus according to claim 3, wherein when said forward insertion-designating area is defined for said division of said editing document, said automatic defining means defines the remaining area of said division other than said forward insertion-designating area, as said backward insertion-designating area.

5. A tape printing apparatus according to claim 3, wherein when said forward insertion-designating area and said backward insertion-designating area are defined for said division of said editing document, said automatic defining means defines the remaining area of said division other than said forward insertion-designating area and said backward insertion-designating area, as said insertion inhibition-designating area.

6. A tape printing apparatus according to claim 2, wherein said designation area-defining means defines all area of each division of said editing document as said backward insertion-designating area.

7. A tape printing apparatus according to claim 2, wherein said designation area-defining means defines a forward half of each division of said editing document as said forward insertion-designating area and a backward half of said each division as said backward insertion-designating area.

8. A tape printing apparatus according to claim 2, wherein said editing document includes line number data, and wherein said designation area-defining means defines an area occupied by said line number data and an area occupied by said character data as respective different ones of said forward insertion-designating area and said backward insertion-designating area.

9. A tape printing apparatus according to claim 2, wherein said designation area-defining means includes means for defining any of said three kinds of designation areas on a line-by-line basis, and wherein said position-designating means designates said position on a line-by-line basis.

10. A tape printing apparatus according to claim 2, wherein said designation area-defining means includes means for defining any of said three kinds of designation areas on a division-by-division basis, and wherein said position-designating means designates said position on a division-by-division basis.

11. A tape printing apparatus according to claim 10, wherein said display means includes means for displaying divisions of said editing document schematically as respective lines when said position is to be designated by said position-designating means.

12. A tape printing apparatus according to claim 2, wherein when said document is printed on said tape, said each division of said editing document is printed over the whole width of said tape, forming a sequence of printed divisions along the length of said tape.

13. A tape printing apparatus according to claim 1 or 2, wherein said position-designating means designates said position within said editing document before said insertion means calls said selected one of said registered documents.

14. A tape printing apparatus according to claim 1 or 2, wherein said position-designating means designates said position within said editing document after said insertion means calls said selected one of said registered documents.

15. A method of calling a registered document and inserting said registered document into an editing document for use by a tape printing apparatus, comprising the steps of:

inputting document data including character data, line feed data, and division break-inserting data;

displaying an editing document formed of said document data;

designating a position within said editing document; and calling a selected one of a plurality of registered documents stored in storage means and inserting the called selected one of said registered documents into said editing document as document data forming a new division of said editing document, at a predetermined one of a forward position immediately before a desired division within said editing document and a backward position immediately after said desired division, said desired division containing said position designated by said position-designating means.

16. A method according to claim 15, including the steps of:

defining at least one of three kinds of designation areas consisting of a forward insertion-designating area, a backward insertion-designating area, and an insertion inhibition-designating area for each division of said editing document;

inserting the called selected one of said registered documents at said forward position immediately before said desired division when the designated position is within said forward insertion-designating area of said desired division;

inserting the called selected one of said registered documents at said backward position immediately after said desired division when the designated position is within said backward insertion-designating area of said desired division; and inhibiting insertion of the called selected one of said registered documents when the designated position is within said insertion inhibition-designating area of said desired division.

* * * * *